US010836595B2

(12) United States Patent
Chiba

(10) Patent No.: US 10,836,595 B2
(45) Date of Patent: Nov. 17, 2020

(54) ROTARY FEEDING MEMBER, SHEET FEEDING APPARATUS AND IMAGE FORMING APPARATUS

(71) Applicant: CANON KABUSHIKI KAISHA, Tokyo (JP)

(72) Inventor: Yoshinao Chiba, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/244,408

(22) Filed: Jan. 10, 2019

(65) Prior Publication Data

US 2019/0225441 A1 Jul. 25, 2019

(30) Foreign Application Priority Data

Jan. 24, 2018 (JP) ..... 2018-010027

(51) Int. Cl.
*B65H 27/00* (2006.01)
*B65H 5/06* (2006.01)
*B65H 3/06* (2006.01)

(52) U.S. Cl.
CPC ..... *B65H 5/06* (2013.01); *B65H 3/0638* (2013.01); *B65H 27/00* (2013.01); *B65H 2404/1115* (2013.01); *B65H 2404/1118* (2013.01); *B65H 2404/1119* (2013.01); *B65H 2513/52* (2013.01); *B65H 2557/35* (2013.01); *B65H 2601/121* (2013.01)

(58) Field of Classification Search
CPC ..... B65H 27/00; B65H 2404/181; B65H 2404/1115; B65H 2404/1118; B65H 2404/1119
See application file for complete search history.

(56) References Cited

U.S. PATENT DOCUMENTS

| | | | | |
|---|---|---|---|---|
| 6,988,727 | B2 | 1/2006 | Yano | |
| 8,807,554 | B2 * | 8/2014 | Mine | B65H 27/00 271/109 |
| 9,254,973 | B2 | 2/2016 | Ishida et al. | |
| 10,138,081 | B2 * | 11/2018 | Shimosaka | B65H 3/0653 |
| 10,294,058 | B2 * | 5/2019 | Shoji | B65H 5/226 |
| 2011/0039671 | A1 * | 2/2011 | Chou | B65H 27/00 492/28 |

FOREIGN PATENT DOCUMENTS

| | | | |
|---|---|---|---|
| JP | 08188271 | * | 7/1996 |
| JP | 2003-261237 | A | 9/2002 |
| JP | 2003-261237 | A | 9/2003 |

* cited by examiner

*Primary Examiner* — Howard J Sanders
(74) *Attorney, Agent, or Firm* — Venable LLP

(57) ABSTRACT

A rotary feeding member includes a plurality of first regions each including a plurality of first protruding portions and a plurality of first recessed portions, and a plurality of second regions each including a plurality of second protruding portions and a plurality of second recessed portions. The plurality of first regions and plurality of second regions are alternately arranged in a rotating direction of the rotary feeding member, and a ratio of a second depth of the second recessed portions to a first depth of the first recessed portions is 0.4 or greater and 0.8 or less.

18 Claims, 14 Drawing Sheets

ROTARY FEEDING MEMBER, SHEET FEEDING APPARATUS AND IMAGE FORMING APPARATUS

BACKGROUND OF THE INVENTION

Field of the Invention

The present invention relates to a rotary feeding member for feeding sheets by rotating in contact with the sheet, a sheet feeding apparatus equipped with the rotary feeding member, and an image forming apparatus for forming an image on a sheet.

Description of the Related Art

In image forming apparatuses such as printers, copying machines and multifunction printers, sheet feeding apparatuses for feeding sheets as recording media or original documents are equipped with rotary feeding members such as rollers for feeding sheets by rotating in contact with the sheets. In many cases, a surface of the roller is formed of a material such as rubber that has a high friction coefficient with respect to sheets, and sheets are conveyed by friction between the surface of the roller and the sheet by rotation of the roller. However, the surface of the roller is gradually worn out after repeated sheet conveyance, so the roller is required to be replaced at an appropriate time.

Japanese Patent Application Laid-Open Publication No. 2003-261237 discloses a method for predicting a wear level of a roller for feeding sheets from a sheet feed cassette, using a sheet detection sensor that detects presence of a sheet at a position downstream of the roller. This method utilizes that conveyance efficiency (i.e., sheet conveyance distance per one rotation of roller) deteriorates as the roller gets worn down and predicts the wear level of the roller by applying a delay of detection time of the sheet detection sensor compared to a theoretical time to a prediction function. When a delay ratio of an actual detection time of the sheet detection sensor to the theoretical time exceeds a predetermined threshold, it is determined that the roller has reached the end of service life.

The above-described document presupposes that conveyance efficiency is gradually deteriorated as the wear of the roller advances. However, the inventors of the present disclosure have found, through an endurance test where sheets were repeatedly fed while the actual detection time of the sheets were measured, that the change of conveyance efficiency with respect to the amount of wear has little linearity, and that there were cases where the conveyance efficiency was deteriorated acutely after a certain number of sheets were fed. In such case, the end of life of the roller is not easily predicted in advance, and there were cases where sheet jam started to occur frequently when wear of the roller was detected based on the detection time.

SUMMARY OF THE INVENTION

According to one aspect of the invention, a rotary feeding member is configured to feed a sheet by rotating in contact with the sheet. The rotary feeding member includes: a plurality of protruding portions that are provided, on a cross-section perpendicular to a width direction of the rotary feeding member, at a plurality of positions in a rotating direction of the rotary feeding member, the plurality of protruding portions constituting an outer circumferential surface of the rotary feeding member to be in contact with the sheet; a plurality of first recessed portions each provided, on the cross-section, between any adjacent two of the plurality of protruding portions in the rotating direction, the plurality of first recessed portions being recessed to a first depth with respect to the outer circumferential surface; and a plurality of second recessed portions each provided, on the cross-section, between any adjacent two of the plurality of protruding portions in the rotating direction separately from the first recessed portions, the plurality of second recessed portions being recessed to a second depth smaller than the first depth with respect to the outer circumferential surface.

According to another aspect of the invention, a sheet feeding apparatus includes: a sheet supporting portion configured to support a sheet; a rotary feeding member configured to feed the sheet in a sheet feeding direction by rotating in contact with the sheet supported on the sheet supporting portion; a sheet detector configured to detect the sheet at a position downstream of the rotary feeding member in the sheet feeding direction; and a controller configured to execute a notification operation of notifying of information about replacement of the rotary feeding member based on a detection result of the sheet detector. The rotary feeding member includes: a plurality of protruding portions that are provided, on a cross-section perpendicular to a width direction of the rotary feeding member, at a plurality of positions in a rotating direction of the rotary feeding member, the plurality of protruding portions constituting an outer circumferential surface of the rotary feeding member to be in contact with the sheet; a plurality of first recessed portions each provided, on the cross-section, between any adjacent two of the plurality of protruding portions in the rotating direction, the plurality of first recessed portions being recessed to a first depth with respect to the outer circumferential surface; and a plurality of second recessed portions each provided, on the cross-section, between any adjacent two of the plurality of protruding portions in the rotating direction separately from the first recessed portions, the plurality of second recessed portions being recessed to a second depth smaller than the first depth with respect to the outer circumferential surface.

According to still another aspect of the invention, an image forming apparatus includes: a rotary feeding member configured to feed a sheet by rotating in contact with the sheet; and an image forming unit configured to form an image on a sheet fed by the rotary feeding member. The rotary feeding member includes: a plurality of protruding portions that are provided, on a cross-section perpendicular to a width direction of the rotary feeding member, at a plurality of positions in a rotating direction of the rotary feeding member, the plurality of protruding portions constituting an outer circumferential surface of the rotary feeding member to be in contact with the sheet; a plurality of first recessed portions each provided, on the cross-section, between any adjacent two of the plurality of protruding portions in the rotating direction, the plurality of first recessed portions being recessed to a first depth with respect to the outer circumferential surface; and a plurality of second recessed portions each provided, on the cross-section, between any adjacent two of the plurality of protruding portions in the rotating direction separately from the first recessed portions, the plurality of second recessed portions being recessed to a second depth smaller than the first depth with respect to the outer circumferential surface.

Further features of the present invention will become apparent from the following description of exemplary embodiments with reference to the attached drawings.

DESCRIPTION OF THE EMBODIMENTS

Now, an image forming apparatus of the present disclosure will be described with reference to the drawings. An image forming apparatus, which may be a printer, a copying machine, a facsimile or a multifunction machine, forms images on sheets based on image information received from an external PC or image information read from an original document. Sheets used as recording media include paper such as plain paper and thick paper, special paper such as coated paper, plastic film for overhead projectors (OHP sheets), and cloth.

Figure 1:
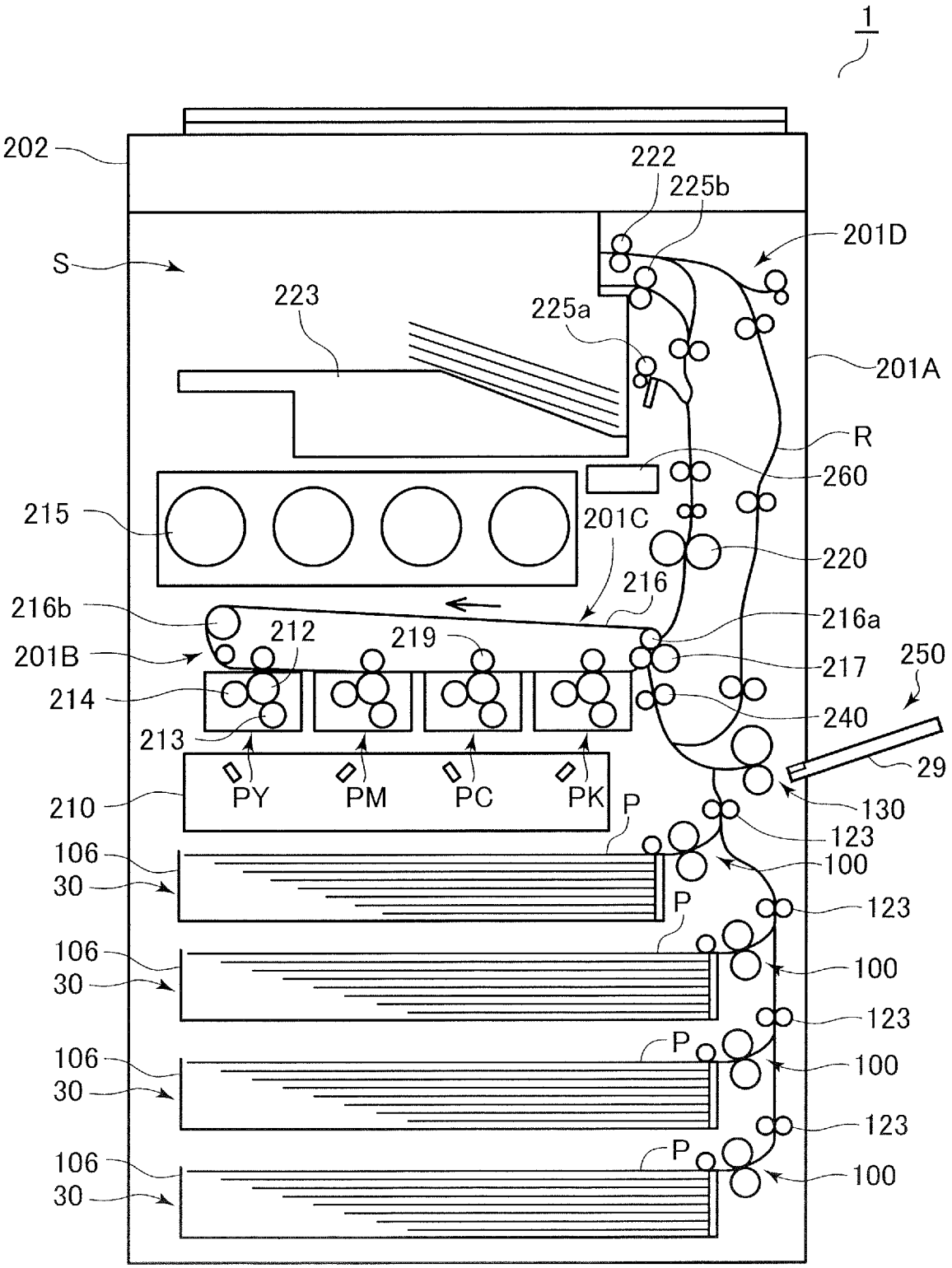
FIG. 1 is a schematic view of an image forming apparatus of the present disclosure.

An image forming apparatus 1 according to the present disclosure is, as illustrated in FIG. 1, a laser printer provided with an image forming unit 201B adopting an electrophotographic system. An image reading apparatus 202 is placed approximately horizontally on an image forming apparatus body (hereinafter referred to as printer body) 201A. A sheet discharge space S, to which sheets are discharged, is formed between the image reading apparatus 202 and the printer body 201A.

The image forming unit 201B is a four-drum full-color electrophotographic unit. That is, the image forming unit 201B includes a laser scanner 210, and four process cartridges PY, PM, PC and PK for forming toner images of four colors, which are yellow (Y), magenta (M), cyan (C) and black (K). Each of the process cartridges PY through PK includes a photosensitive drum 212 serving as a photoconductor, a charging unit 213, and a developing unit 214. Further, the image forming unit 201B includes an intermediate transfer unit 201C arranged above the process cartridges PY through PK, and a fixing unit 220. Toner cartridges 215 for supplying toner to the respective developing units 214 are arranged above the intermediate transfer unit 201C.

The intermediate transfer unit 201C includes an intermediate transfer belt 216 wound around a drive roller 216*a* and a tension roller 216*b*. Primary transfer rollers 219 that contact the intermediate transfer belts 216 at positions opposed to the respective photosensitive drums 212 are provided on an inner side of the intermediate transfer belt 216. The intermediate transfer belt 216 is rotated in a counterclockwise direction in the drawing by the drive roller 216*a* that is driven by a drive unit not shown.

A secondary transfer roller 217 that transfers a color image borne on the intermediate transfer belt 216 onto a sheet P is provided at a position opposed to the drive roller 216*a* of the intermediate transfer unit 201C. The fixing unit 220 is arranged above the secondary transfer roller 217, and a first sheet discharge roller pair 225*a*, a second sheet discharge roller pair 225*b* and a duplex reverse portion 201D are arranged above the fixing unit 220. The duplex reverse portion 201D includes a reverse conveyance roller pair 222 capable of rotating in normal and reverse directions, and a reconveyance path R through which the sheet having an image formed on one side is conveyed again to the image forming unit 201B. Further, the image forming apparatus 1 includes a controller 260 for controlling an image forming operation, a sheet feeding operation and so on.

The image forming operation of the image forming unit 201B will now be described. Image information of a document is read through the image reading apparatus 202, subjected to image processing by the controller 260, converted into electric signals and transmitted to the laser scanner 210 of the image forming unit 201B. In the image forming unit 201B, a laser beam from the laser scanner 210 is projected to the photosensitive drum 212 whose surface is charged uniformly to certain polarity and potential by the charging unit 213, and the surface of the drum is exposed along with the rotation of the drum. Thereby, electrostatic latent images corresponding to single-color images of yellow, magenta, cyan and black, are formed on the surface of the respective photosensitive drums 212 in the respective process cartridges PY through PK. The electrostatic latent images are developed and visualized with toner of respective colors supplied from the developing unit 214, before being primarily transferred in a superposed manner from the photosensitive drums 212 to the intermediate transfer belt 216 by a primary transfer bias applied to the primary transfer rollers 219.

Along with this operation, a sheet P is fed one at a time from any one of sheet feeding portions 30 and 250 toward a registration roller pair 240. At a lower portion of the printer body 201A are provided a plurality of sheet feeding portions 30, each of which are equipped with cassettes 106 storing sheets and sheet feed units 100 that feed the sheets P stored in the respective cassettes 106. The configuration of the sheet feed units 100 will be described later.

Each sheet feed unit 100 feeds an uppermost sheet from the stack of sheets P stored in the cassette 106 one at a time. The sheet P sent out by the sheet feed unit 100 is conveyed upward by a conveyance roller pair 123 toward the registration roller pair 240. Further, a sheet set on a manual feed tray 29 is fed from a manual sheet feeding portion 250 provided on a side portion of the printer body 201A by the sheet feed unit 100 toward the registration roller pair 240.

After correcting skewing of the sheet P, the registration roller pair 240 sends out the sheet P toward the secondary transfer roller 217 synchronously with the advancement of formation of toner image by the image forming unit 201B. A full-color toner image is collectively secondarily transferred to the sheet P at a transfer portion, i.e., secondary transfer portion, formed between the secondary transfer roller 217 and the intermediate transfer belt 216, by secondary transfer bias applied to the secondary transfer roller 217. The sheet P onto which toner image has been transferred is conveyed to the fixing unit 220, and heat and pressure is applied in the fixing unit 220 to melt and mix the toners of respective colors, by which the toner image is fixed to the sheet P as a color image.

Thereafter, the sheet P is discharged by the first or second sheet discharge roller pair 225*a* or 225*b* arranged downstream of the fixing unit 220 and supported on a sheet discharge portion 223 arranged at a bottom portion of the sheet discharge space S. In order to form images on both sides of the sheet P, the sheet P having an image formed on a first side is reversed by the reverse conveyance roller pair 222 and conveyed to the reconveyance path R, and then the sheet is conveyed again to the image forming unit 201B. The sheet P having an image formed on a second side thereof by the image forming unit 201B is discharged by the first or second sheet discharge roller pair 225*a* or 225*b* to the sheet discharge portion 223.

The image forming unit 201B described above is merely an example of the image forming unit, and it may also be possible to use a direct transfer-type image forming unit where the toner image formed on the photoconductor is directly transferred to the sheet. Moreover, an image forming unit adopting an inkjet printing system or an offset printing system may also be used instead of the electrophotographic system.

Sheet Feeding Portion

Figure 2A:
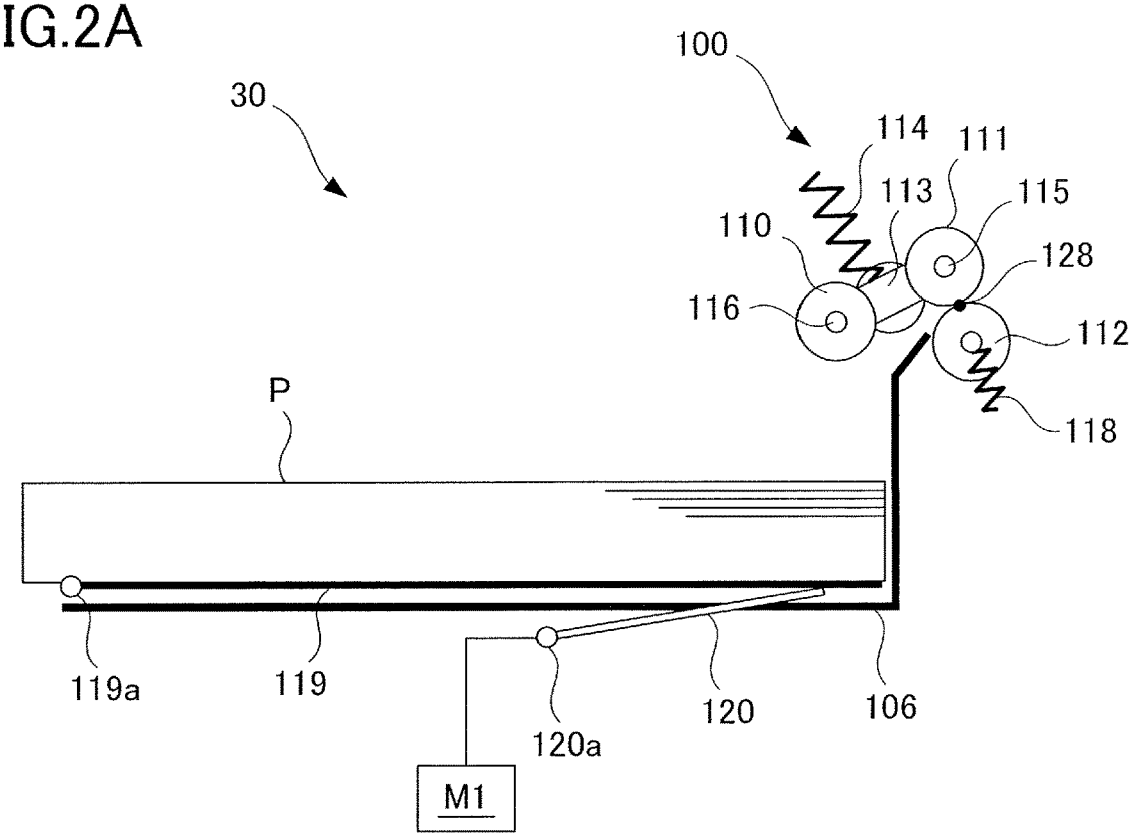
FIG. 2A is a schematic view of a sheet feeding portion in a state where a sheet supporting portion is at a standby position.
Figure 2B:
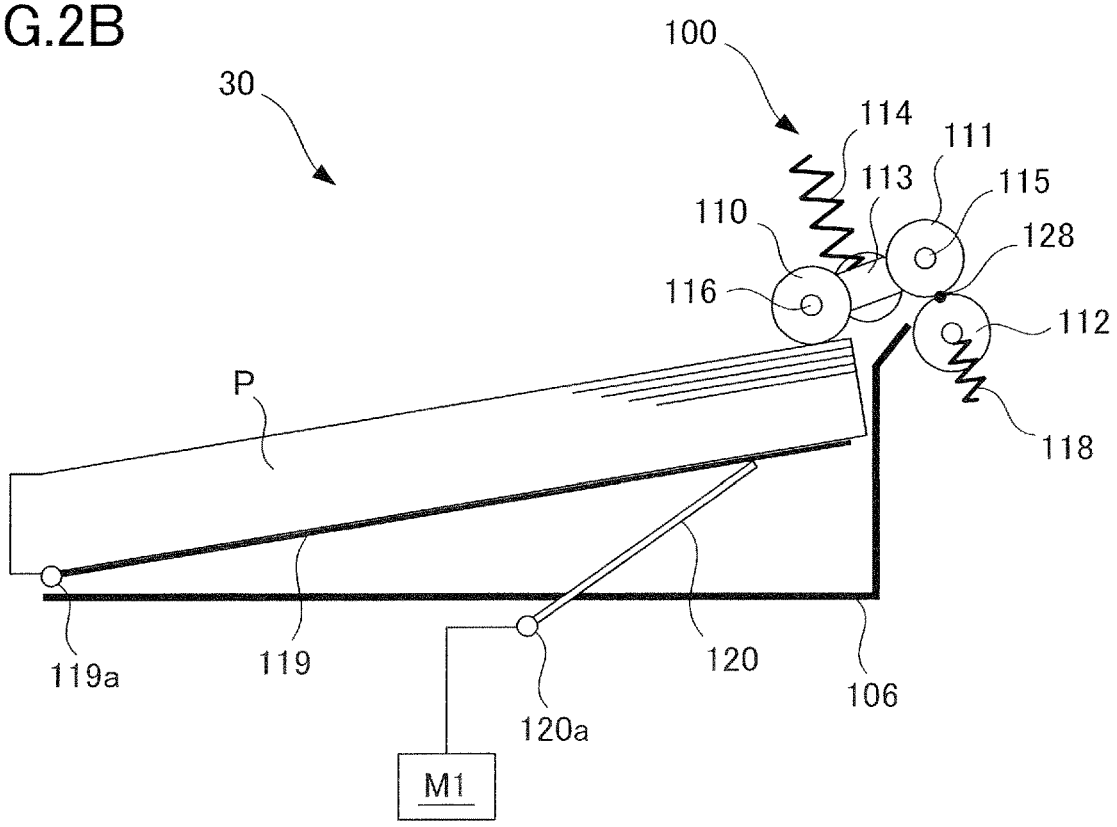
FIG. 2B is a schematic view of the sheet feeding portion in a state where the sheet supporting portion is at a feeding position.

A configuration of the sheet feeding portion 30 serving as an example of a sheet feeding apparatus will be described. The sheet feeding portion 30 includes, as illustrated in FIGS. 2A and 2B, one of the cassettes 106, and one of the sheet feed units 100 for feeding the sheets stored in the cassette 106. The cassette 106 is detachably attached to (that is, capable of being drawn out of and removed from) the printer body 201A shown in FIG. 1.

The cassette 106 includes a sheet supporting portion 119 that serves as a sheet supporting portion configured to support sheets, and a lifting plate 120 that supports and lifts up and down the sheet supporting portion 119. The sheet supporting portion 119 is capable of pivoting in a vertical direction, that is, being lifted and lowered, about a pivot shaft 119*a*. The lifting plate 120 is arranged below the sheet supporting portion 119 and capable of pivoting in the vertical direction about a lifting shaft 120*a* by a lifting motor M1. The sheet supporting portion 119 is pushed up from below by the lifting plate 120 and is lifted from a standby position illustrated in FIG. 2A to a feeding position illustrated in FIG. 2B. Then, in a state where the sheet supporting portion 119 reaches the feeding position, the sheet P supported on the sheet supporting portion 119 comes into contact with a pickup roller 110 of the sheet feed unit 100.

The sheet feed unit 100 includes the pickup roller 110, and a feed roller 111 and a retard roller 112 that constitute a separation nip 128. The pickup roller 110 is an exemplary first roller that delivers out a sheet from the sheet supporting portion, and the feed roller 111 is an exemplary second roller that cooperates with a retard roller serving as a separation member to separate and convey the sheet. Each of the pickup roller 110 and the feed roller 111 is an example of a rotary feeding member configured to feed a sheet by rotating in contact with the sheet.

Figure 3:
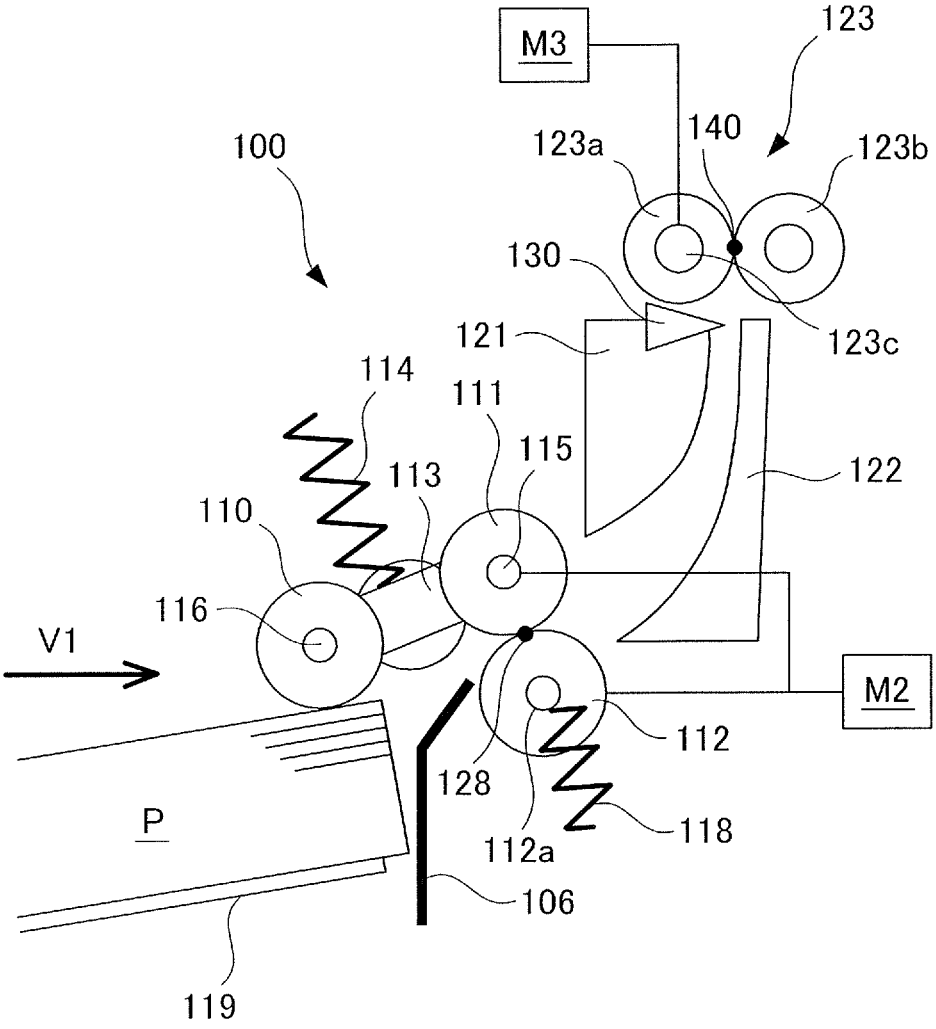
FIG. 3 is an enlarged view illustrating a vicinity of a sheet feed unit.
Figure 4:
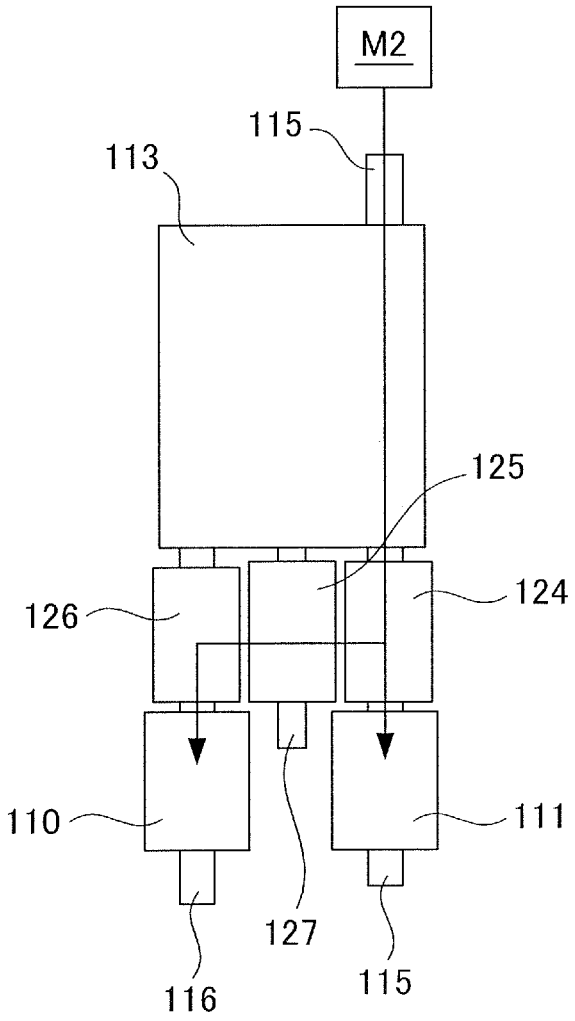
FIG. 4 is an upper view of the sheet feed unit.

FIG. 3 is a schematic view illustrating a cross-sectional configuration of the sheet feed unit 100 viewed in a width direction of the sheet, that is, a direction orthogonal to a sheet feeding direction V1 of the sheet feed unit 100, and FIG. 4 is a schematic view illustrating the sheet feed unit 100 from above. As illustrated in FIGS. 3 and 4, the feed roller 111 is rotatably supported on a feed roller shaft 115 that is driven by a feed motor M2. A lifting plate 113 is supported swingably in the vertical direction on the feed roller shaft 115.

An idler shaft 127 and a pickup roller shaft 116 are rotatably supported on the lifting plate 113, and the pickup roller 110 is rotatably supported on the pickup roller shaft 116. A feed gear 124, an idler gear 125 and a pickup gear 126 are respectively attached to the feed roller shaft 115, the idler shaft 127 and the pickup roller shaft 116. The feed gear 124, the idler gear 125 and the pickup gear 126 transmit rotation of the feed roller shaft 115 that is driven by the feed motor M2 to the pickup roller shaft 116. That is, the pickup roller 110 and the feed roller 111 rotate in a rotating direction along the sheet feeding direction V1 (i.e., counterclockwise direction in the drawing) by driving force of the feed motor M2 serving as a driving source.

The lifting plate 113 is urged downward by a pickup spring 114 serving as an urging member. In a state where the sheet supporting portion 119 is at the feeding position, the pickup roller 110 contacts an upper surface of the sheet by predetermined feeding pressure by the urging force of the pickup spring 114. The retard roller 112 serving as the separation member is rotatably supported on a retard shaft 112*a* via a torque limiter not shown and is urged toward the feed roller 111 by a retard spring 118 serving as another urging member. Thereby, the retard roller 112 is in pressure contact with the feed roller 111 at the separation nip 128 serving as a nip portion. Further, driving force from the feed motor M2 is transmitted to the retard shaft 112*a* together with the feed roller shaft 115. Therefore, the retard roller 112 attempts to rotate in a direction by which the sheet P is pushed back toward the cassette 106 (that is, counterclockwise direction in FIG. 3) at the separation nip 128 by the driving force of the feed motor M2.

An inner guide 121, an outer guide 122 and the conveyance roller pair 123 are arranged downstream of the feed roller 111 and the retard roller 112 in the sheet feeding direction V1. The conveyance roller pair 123 has a drive roller 123*a*, serving as a conveyance rotary member, and a driven roller 123*b*, wherein the drive roller 123*a* is rotatably supported on a rotation shaft 123*c*. In a state where the rotation shaft 123*c* is driven by a conveyance motor M3, the drive roller 123*a* rotates and the driven roller 123*b* is rotated by the drive roller 123*a*. A conveyance sensor 130 for detecting sheets is arranged upstream in the sheet feeding direction of a conveyance nip 140 that is formed by the drive roller 123*a* and the driven roller 123*b*, and downstream of the separation nip 128. The conveyance sensor 130 is one example of a sheet detector that detects a sheet at a position downstream of the rotary feeding member in the sheet feeding direction V1.

Sheet Feeding Operation

If a sheet feeding job is entered, or if the cassette 106 is inserted to the printer body 201A, the lifting motor M1 is driven and the sheet supporting portion 119 is lifted up. The position of an uppermost sheet supported on the sheet supporting portion 119 is detected by a sensor not shown, and as illustrated in FIG. 2B, the sheet supporting portion 119 is stopped when the uppermost sheet reaches a predetermined height.

In this state, the feed motor M2 serving as a first driving source and the conveyance motor M3 serving as a second driving source are driven, and the pickup roller 110 feeds the sheet supported on the sheet supporting portion 119. The sheet fed by the pickup roller 110 is separated from another sheet by the separation nip 128. Specifically, if only one sheet enters the separation nip 128, the torque limiter provided between the retard shaft 112*a* and the retard roller 112 runs idly, and the retard roller 112 rotates following the feed roller 111. If two or more sheets enter the separation nip 128, the retard roller 112 rotates in a direction by which a sheet is returned to the cassette 106, so that the second and subsequent sheets slip with respect to the uppermost sheet and are returned to the cassette 106. A roller member that does not receive driving force may be used as the retard roller 112, or instead of the roller member, a separation member (e.g., separation pad) may be provided on a pad that contacts the feed roller 111.

The sheet separated one by one at the separation nip 128 is guided by the inner guide 121 and the outer guide 122 to the conveyance roller pair 123, and the sheet is conveyed further by the conveyance nip 140 of the conveyance roller pair 123. In the present embodiment, sheet conveyance speeds of the pickup roller 110, the separation nip 128 and the conveyance nip 140 (that is, peripheral speeds of the feed roller 111 and the drive roller 123*a*) are set to be substantially the same, but the technique of the present disclosure is not restricted to this example. For example, the sheet conveyance speed by the conveyance nip 140 may be set greater than the sheet conveyance speed of the pickup roller 110 and the separation nip 128, so as to improve productivity. In that case, it is preferable to provide built-in one-way clutches to the pickup roller 110 and the feed roller 111, so as to allow relative rotation with respect to corresponding roller shafts 115 and 116. Thereby, after a leading edge of the sheet has reached the conveyance nip 140, coupling between the feed motor M2 and the respective rollers 110 and 111 are disengaged, preventing the sheet from being pulled by both the conveyance nip 140 and the separation nip 128.

Control Configuration

Figure 5:
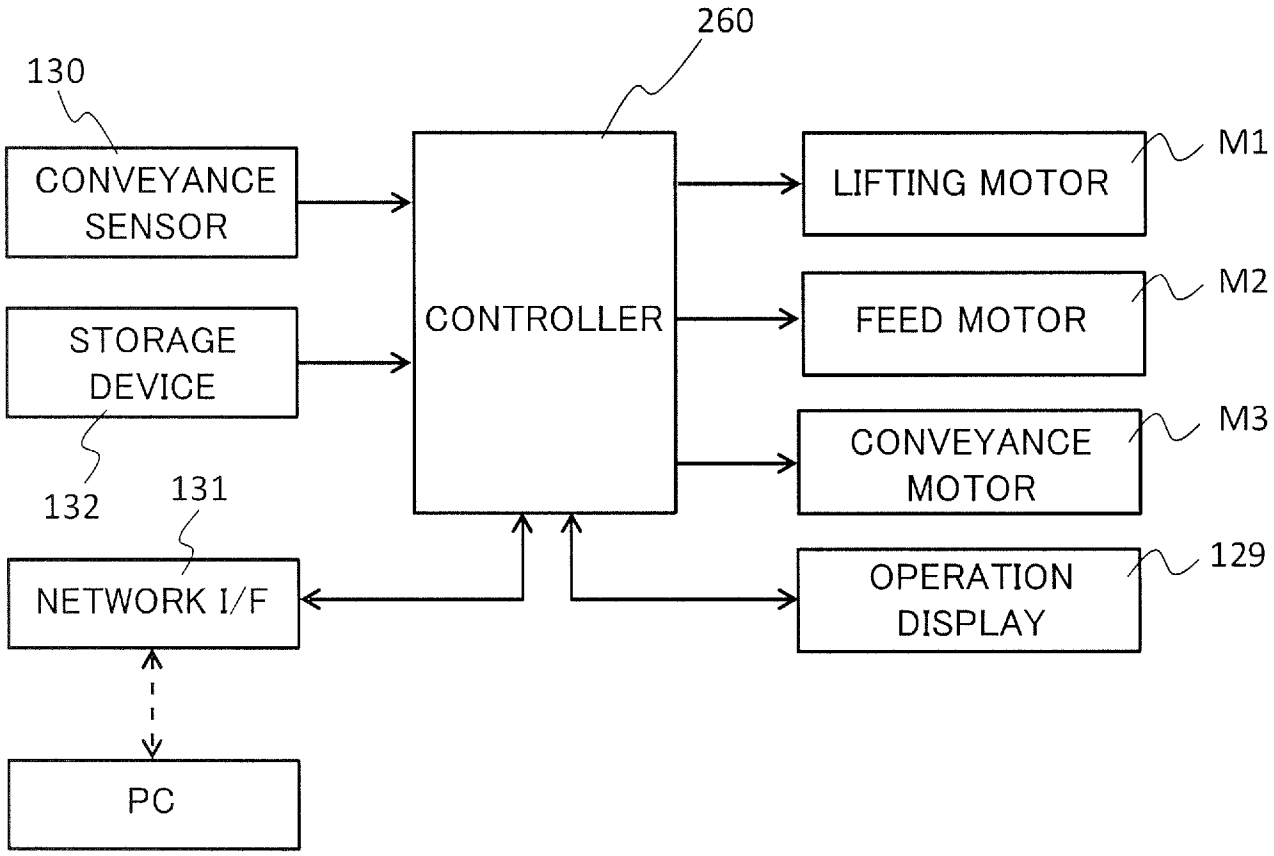
FIG. 5 is a block diagram illustrating a control configuration of the sheet feeding portion.

FIG. 5 is a block diagram illustrating a control configuration of the sheet feeding portion 30. The operation of the sheet feeding portion 30 is controlled by the controller 260 provided on the printer body 201A. The controller 260 includes at least one processor and performs integrated control of the operation of the image forming apparatus 1 by reading and executing programs on a storage device 132. The storage device 132 includes, for example, a Read Only Memory (ROM), a Random Access Memory (RAM) and a hard disk drive. The storage device 132 not only stores control programs of the image forming apparatus 1 and setting information of the image forming operation temporarily or permanently, but also provides workspace for the controller 260 to execute the control programs.

An operation display 129 is provided as a user interface on the image forming apparatus 1. The operation display 129 is equipped with a display device such as a liquid crystal panel for displaying information represented by images to users, and an input device such as a touch panel that enables a user to perform input operations. A user or a maintenance personnel can change setting information stored in the storage device 132 by performing operation through the operation display 129. Further, the controller 260 is equipped with a network interface (I/F) 131 for connecting to a network such as a LAN. Thereby, the image forming apparatus 1 is capable of sending and receiving data to and from an external device such as a personal computer (PC) through a network I/F 131 serving as a communication unit.

Regarding control of the sheet feeding portion 30, the controller 260 performs ON/OFF and speed control of the lifting motor M1, the feed motor M2 and the conveyance motor M3 based on a detection result from the conveyance sensor 130 described above. Further, the controller 260 performs end-of-life signal detection control of the pickup roller 110 or the feed roller 111 described later, based on setting information stored in the storage device 132.

First Embodiment

A roller serving as a rotary feeding member according to a first embodiment and a method for detecting end-of-life signal thereof will be described with reference to FIGS. 6 through 12. A roller 101 according to the present embodiment is used for either one of or both the pickup roller 110 and the feed roller 111 in the sheet feeding portion 30 described above.

Figure 6:
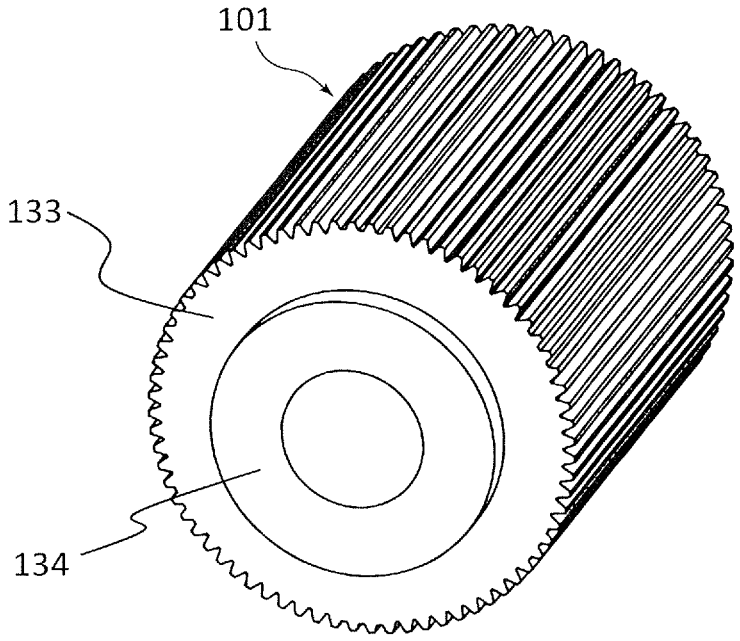
FIG. 6 is a perspective view of a roller according to a first embodiment.

As illustrated in FIG. 6, the roller 101 is composed of an outer portion 133 formed of rubber material and a core 134 formed of synthetic resin. The core 134 is detachably attached to a roller shaft. The cylindrical outer portion 133 rotates together with the core 134 in a state attached on the outer circumference of the core 134. A knurling, that is, a pattern where regular protrusions and recesses appear repeatedly in a circumferential direction, is formed on the surface of the outer portion 133.

Figure 7A:
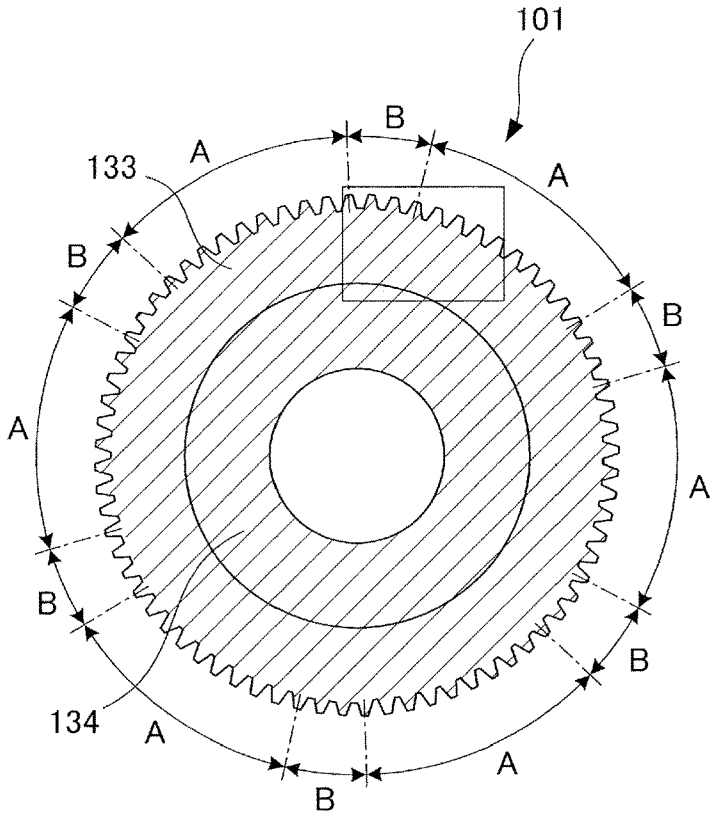
FIG. 7A is a cross-sectional view of the roller according to the first embodiment.
Figure 7B:
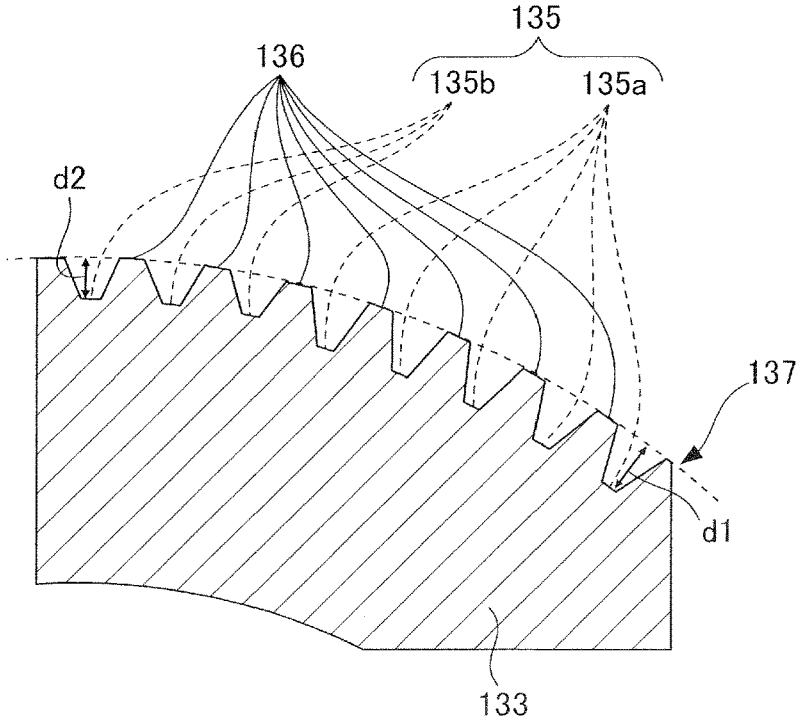
FIG. 7B is an enlarged view of the roller according to the first embodiment.

FIG. 7A is a cross-sectional view illustrating the roller 101 viewed in a width direction, which is the same as an axial direction of the roller in the present embodiment, and FIG. 7B is a view having enlarged the area shown by the rectangle in FIG. 7A. As illustrated in FIGS. 7A and 7B, the knurling of the roller 101 is constituted by a plurality of protruding portions 136 and a plurality of recessed portions 135 arranged alternately in the circumferential direction. The protruding portions 136 each protrude outwardly in a radial direction, and the tip faces of the protruding portions constitute an outer circumferential surface 137 that has a cylindrical shape. The recessed portions 135 are recessed inwardly in radial directions (i.e., toward the rotation axis of the roller 101) from the outer circumferential surface 137, and each recessed portion 135 is provided at areas between any adjacent two of the protruding portions 136. As illustrated in FIGS. 6 through 7B, the recessed portions 135 are grooves that extend in parallel with each other along the axial direction from one end to the other end of the outer portion 133 in the axial direction. Each of the protruding portions 136 is a ridge-shaped protrusion that extends in the axial direction at areas between any adjacent two of the recessed portions 135. The outer circumferential surface 137 of the roller 101 mainly contacts the sheet, and the roller 101 rotates in a body with a roller shaft on which the core 134 is attached while applying frictional force to the sheet, by which the sheet is conveyed.

The recessed portions 135 function to reduce adhesion of fine foreign substances on the tip faces of the protruding portions 136 by trapping such foreign substances on the sheet surface. Since adhesion of foreign substances to the protruding portions 136 is reduced, deterioration of friction coefficient between the roller 101 and the sheet can be suppressed over a long period of time. A typical example of such foreign substances is paper dust, so hereafter, foreign substances are referred to as "paper dust".

Figure 8:
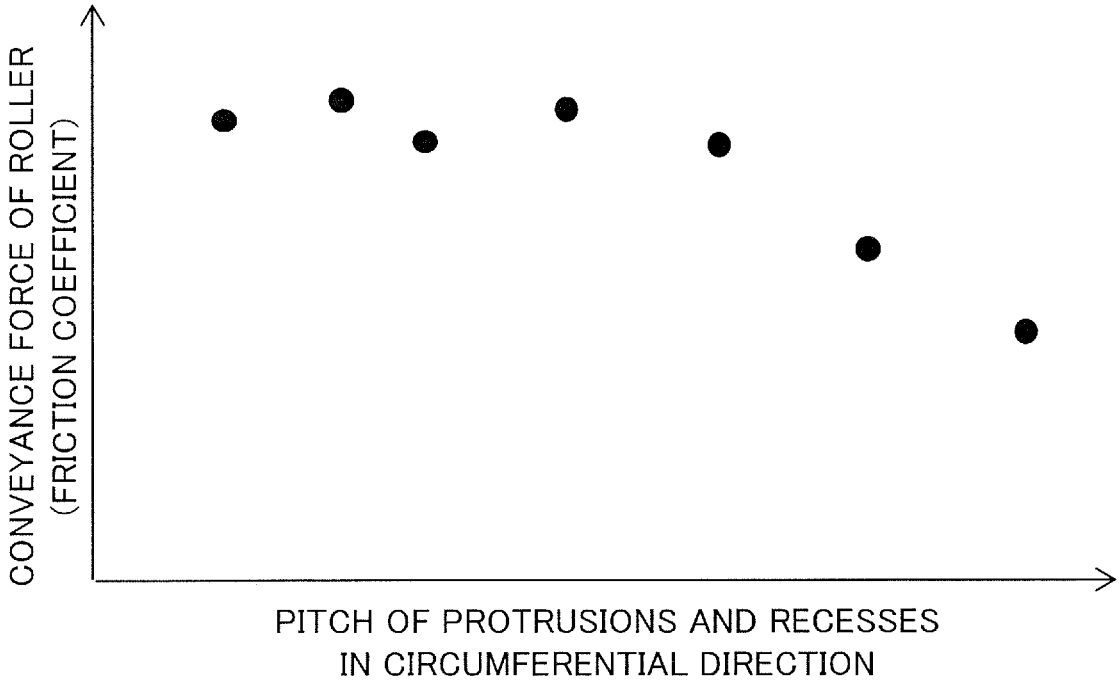
FIG. 8 is a graph illustrating a relationship between a pitch of protrusions and recesses on the roller surface and conveyance force.

The inventors have measured the level of conveyance force applicable to sheets (that is, the level of friction coefficient applied between the sheet and the roller) using a sheet with much paper dust and a roller having various knurling designs. As a result, as illustrated in FIG. 8, the inventors have found that higher conveyance force was achieved by finer pitches of knurling in the circumferential direction. These results are interpreted that when the pitch of the knurling is fine enough, paper dust adhered on the tip face of any protruding portions 136 will easily escape to adjacent recessed portions 135.

A method for detecting delay of conveyance of the sheet may be utilized as a method for detecting end-of-life signal for determining whether a rotary feeding member such as the roller 101 is nearing its end of life, that is, whether the roller 101 has nearly reached the limit of service life. If the protruding portions 136 are worn out by repeated conveyance of sheets, the ability of the recessed portions 135 to trap paper dust is lost or deteriorated, and friction coefficient between the roller 101 and the sheet drops. As a result, conveyance efficiency of the sheet (that is, conveyance distance of the sheet per one rotation of the roller 101) is deteriorated, and the time required for the sheet to reach a predetermined position on the conveyance path is elongated. Utilizing these characteristics, whether end of service life of the roller 101 is near may be determined, predicting the amount of wear of the roller 101 based on a deviation of timing at which the sheet reaches the above-described conveyance sensor 130. If it is determined that the end of life of the roller 101 is near, a notice should be sent to a user or a maintenance personnel to recommend replacement of the roller 101, before the roller 101 is totally worn out and conveyance of the sheet becomes almost impossible.

However, as a result of an endurance test, which the inventors have performed, that sheets were repeatedly fed while acquiring the timing at which the sheet had passed the conveyance sensor 130, it had been observed that the sheet conveyance efficiencies dropped suddenly immediately before jamming of sheet occurs. More specifically, jamming occurred after feeding an average of approximately 270,000 sheets, whereas significant drop of conveyance efficiency occurred just 2000 to 3000 sheets before jamming occurred.

As described, if wear of the roller 101 advances to a certain level and the conveyance efficiency drops suddenly, it becomes difficult to predict the end of life of the roller 101 precisely before jamming starts to occur frequently. This is because while the roller 101 exerts a conveyance efficiency similar to that of a new roller for a long period of time after replacement, at a point of time where conveyance efficiency drops significantly and the drop is observed through the conveyance sensor 130, wear of the roller 101 has already advanced to a level where jamming easily occurs. Even if the end of life of the roller 101 could be predicted before jamming starts to occur frequently, jamming may easily occur when wear of the roller advances slightly. Therefore, jamming may still occur before the roller 101 is replaced. If a setting is adopted where feeding of sheets from the sheet feeding portion 30 is not performed when deterioration of conveyance efficiency is detected, the sheet feeding portion 30 cannot be used until the roller 101 is replaced, causing inconvenience to users.

Therefore, according to the present embodiment, as illustrated in FIGS. 7A and 7B, two types of regions ("A" and "B") are provided, where the depths of the recessed portions 135 differ. In each A-region serving as a first region of the present embodiment, relatively deep recessed portions 135*a* serving as first recessed portions of the present embodiment are formed, whereas in each B-region serving as a second region of the present embodiment, relatively shallow recessed portions 135*b* serving as a second recessed portion of the present embodiment are formed. In other words, a depth d2 of the recessed portions 135*b* in the B-regions is smaller than a depth d1 of the recessed portions 135*a* in the A-regions (d2<d1). Depths d1 and d2 of the recessed portions 135*a* and 135*b* refer to distances from the cylindrical outer circumferential surface 137 formed by the protruding portions 136 to the bottoms of the recessed portions 135*a* and 135*b* in radial directions regarding the rotation axis of the roller 101. Here, a distance, from the rotation axis of the roller 101 to the tip faces at the outer ends of the protruding portions 136 in radial directions, can be deemed constant throughout both A-regions and B-regions.

A plurality of the A-regions and a plurality of the B-regions are alternately arranged in the circumferential direction on the roller 101, and a plurality of recessed portions 135*a* are arranged in each A-region and a plurality of recessed portions 135*b* are arranged in each B-region. In other words, the surface of the outer portion 133 of the roller 101 is formed so that sections (i.e., A-regions), in which protrusions and recesses of a first height in radial directions are formed in a row, and sections (i.e., B-regions), in which protrusions and recesses of a second height that is lower than the first height are formed in a row, are arrayed so as to appear alternately in terms of the circumferential direction.

Changes Caused by Wear of Roller

Figure 9A:
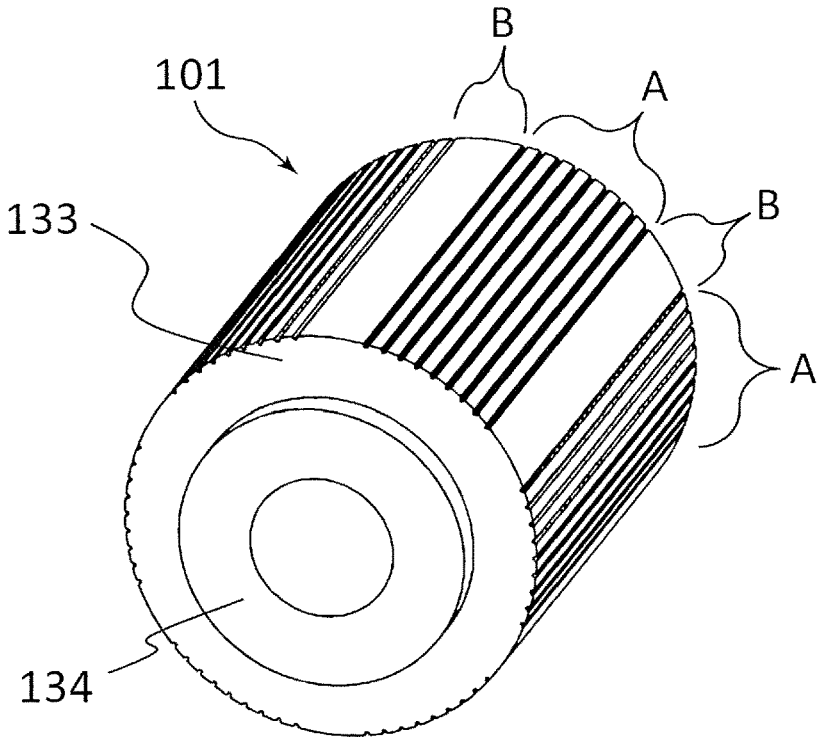
FIG. 9A is a perspective view illustrating a change of surface shape by wear of the roller according to the first embodiment.

Changes caused by wear of the roller 101 according to the present embodiment will be described. As described earlier, in the initial state, the roller 101 has a knurling formed across the whole circumference. By repeated feeding of sheets, the protruding portions 136 of the knurling are gradually worn out. When the protruding portions 136 are worn out to a certain level, that is, approximately equivalent to depth d2 of the recessed portions 135*b*, as illustrated in FIG. 9A, the knurling in the B-regions disappears, and the B-regions becomes smooth surfaces along a cylindrical shape. In this state, the knurling in the A-regions remains, thus the A-regions still maintain their function to reduce adhesion of paper dust on the protruding portions 136. As a result, conveyance force that is approximately equivalent to that in the initial state is exerted at a moment when any one of the A-regions is in contact with the sheet, while conveyance force is significantly deteriorated due to paper dust at a moment when any one of the B-regions is in contact with the sheet.

Figure 9B:
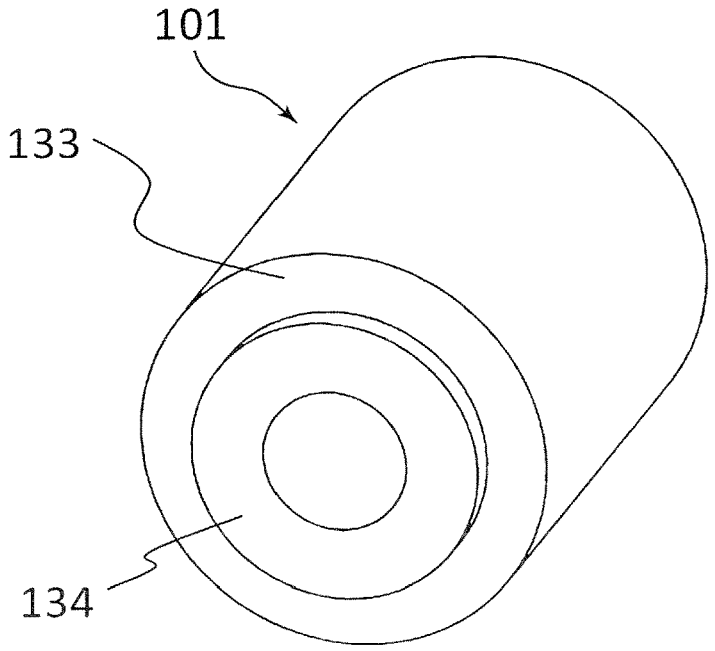
FIG. 9B is a perspective view illustrating a change of surface shape by wear of the roller according to the first embodiment.

If feeding of sheets is repeated further, as illustrated in FIG. 9B, wear of the protruding portions 136 in the A-regions is advanced further, and the knurling in the A-regions will also disappear. Then, the effect of reducing adhesion of paper dust is lost across the whole circumference, and only a low conveyance force compared to the initial state can be exerted regardless of the area of the roller 101 being in contact with the sheet.

Figure 10:
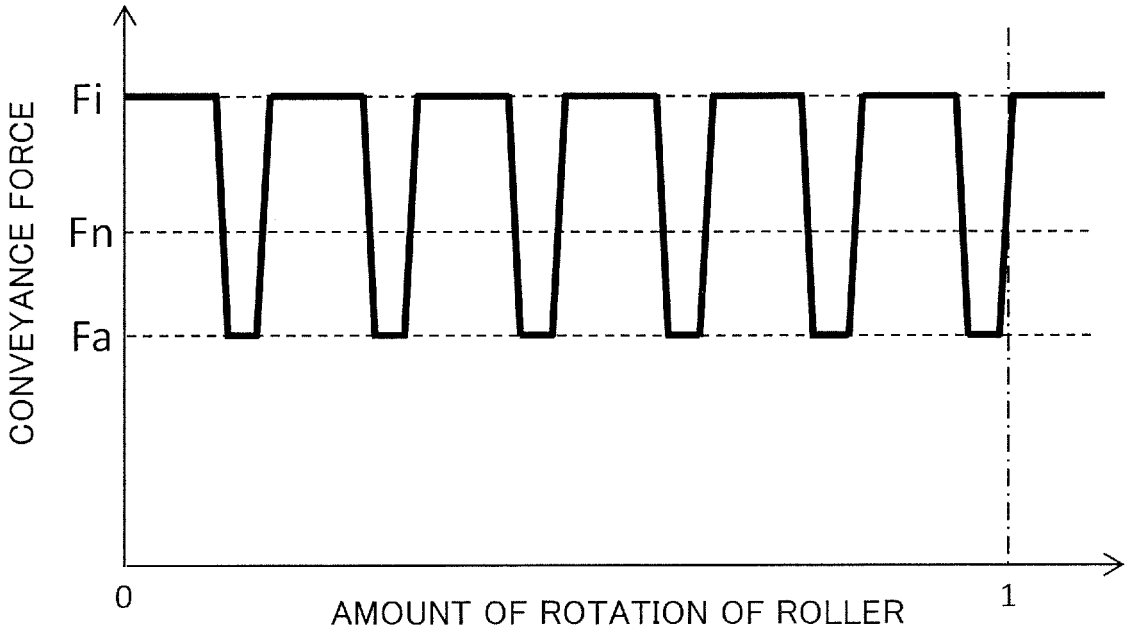
FIG. 10 is a graph illustrating a relationship between amount of rotation of roller and conveyance force according to the first embodiment.

FIG. 10 is a concept diagram illustrating the transition of conveyance force applied to the sheet while the roller 101 in the state shown in FIG. 9A rotates once. In the drawing, Fi represents an initial conveyance force of the roller 101, Fn represents a conveyance force necessary to convey the sheet, and Fa represents a conveyance force in a state where the knurling has been lost (FIG. 9B). The relationship of Fi, Fn and Fa is as follows:

$$Fi>Fn>Fa.$$

This shows that in the initial state, the roller 101 (FIG. 6) exerts the conveyance force Fi that is greater than the force Fn necessary to convey the sheet across the whole circumference, but in a state where the knurling has been lost (FIG. 9B), only the conveyance force Fa that is smaller than Fn can be exerted throughout the whole circumference.

If the roller 101 according to the present embodiment is used, after transiting from the initial state (FIG. 6) and before the knurling is totally lost, the knurling remains only in the A-regions, as illustrated in FIG. 9A. In this state, as illustrated by the solid line of FIG. 10, the conveyance force that the roller 101 is capable of applying to the sheet is varied periodically where Fi and Fa are alternately repeated along with the rotation of the roller 101. Conveyance force Fi is realized in sections where one of the A-regions, in which the knurling remains, is in contact with the sheet, and conveyance force Fa is realized in sections where one of the B-regions, in which the knurling has been lost, is in contact with the sheet. In this state, since a section remains where the conveyance force Fi is realized, the conveyance of the sheet is still feasible, but in the section where conveyance force is Fa, the sheet is hard to move against the conveyance resistance, and the conveyance distance of the sheet while the roller 101 rotates once is reduced. That is, compared to the initial state, the conveyance efficiency of the roller 101 is deteriorated, and the arrival time of the sheet to the conveyance sensor 130 is delayed.

Transition of Arrival Time to Conveyance Sensor

Figure 11:
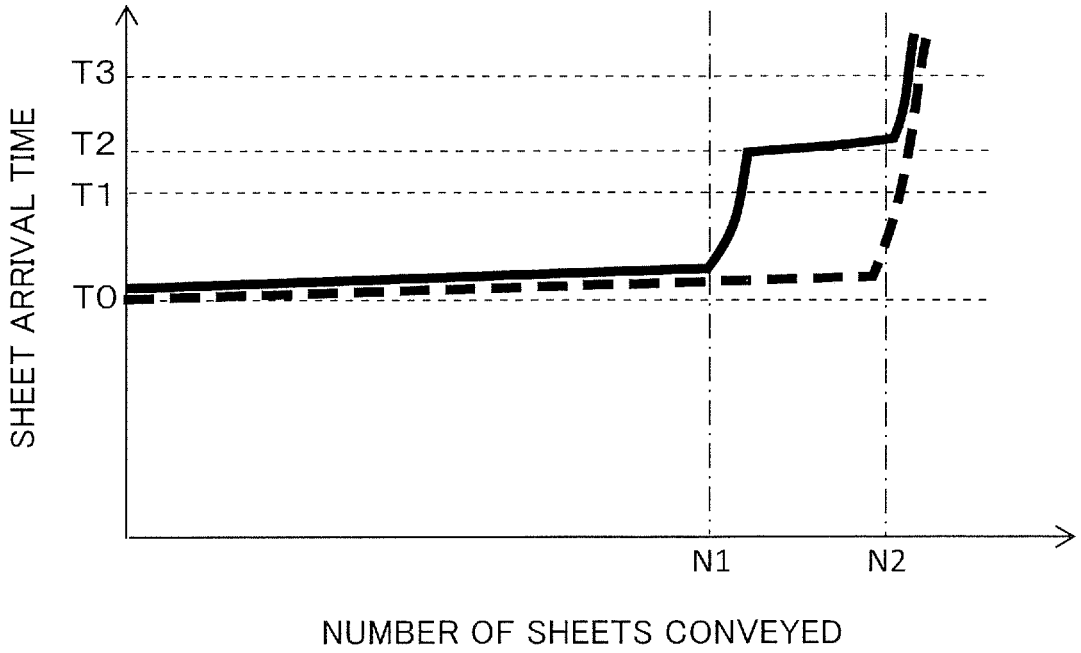
FIG. 11 is a graph illustrating a relationship between number of sheets conveyed and sheet arrival time to the conveyance sensor using the roller according to the first embodiment.

FIG. 11 illustrates a typical transition of sheet arrival time to the conveyance sensor 130 in a state where feeding of sheets is repeatedly performed. The solid line indicates a case where the roller 101 according to the present embodiment is used, and the broken line indicates a case where a roller according to a reference example where the depths of the recessed portions 135 are set to be the same throughout the whole circumference as the depth of the deeper recessed portions 135*a*. The sheet arrival time refers to an elapsed time from a reference time where driving of the feed motor M2 is started in a state where the sheet supporting portion 119 is at the feeding position to when the conveyance sensor 130 detects the sheet.

In the drawing, T3 represents a limit (i.e., a predetermined length of time) of the sheet arrival time where the sheet feeding portion 30 is allowed to continue feeding of sheets. Productivity of the image forming apparatus 1 is generally maximized when the sheets are supplied to the image forming unit 201B while keeping a predetermined sheet-to-sheet interval. Therefore, if the sheet arrival time to the conveyance sensor 130 is delayed compared to a theoretical sheet arrival time (T0), the supply interval of sheets to the image forming unit 201B is adjusted by increasing the conveyance speed of the sheets. However, in the present embodiment, if the sheet arrives at a time after the limit time of T3 to the conveyance sensor 130, the sheet cannot achieve such interval by the interval required by the image forming unit 201B even if the feed motor M2 and the conveyance motor M3 are operated at the maximum speed. Therefore, it is determined in the present embodiment that feeding of sheets by the sheet feeding portion 30 is impossible in practice in a case where the sheet has not reached the conveyance sensor 130 when it past the time limit of T3.

As illustrated by the dotted line of FIG. 11, in the case of the roller 101 according to the present embodiment, the sheet arrival time to the conveyance sensor 130 is only slightly but gradually delayed after repeated feeding of sheets. The reason for this is that the outer portion 133 of the roller 101 is gradually worn out. However, in a state where the knurling of the A-regions and the B-regions remains, that is, number of sheets conveyed is smaller than N1, only a small adhesion of paper dust to the protruding portions 136 occurs, and the sheet arrival time is not delayed greatly.

When the number of sheets conveyed reaches N1 after repeating feeding of sheets further, as illustrated in FIG. 9A, it is assumed that the knurling of the B-regions has been lost and only the knurling of the A-regions remains. Then, the sheet arrival time starts to change quickly. As described earlier, if the sheet is fed by the roller 101 in this state, the arrival time of the sheet to the conveyance sensor 130 will be at a time T2 that is more delayed than the initial time (T0). However, since the A-regions exerts an approximately same level of conveyance force Fi as the initial state, the sheet can be fed though delayed, and therefore, sheet arrival time T2 does not exceed T3.

Repeating feeding of sheets still further, the protruding portions 136 in the A-regions are also gradually worn out. Then, if number of sheet feed reaches approximately N2, the protrusions and recesses in the A-regions also start to disappear, and the conveyance force drops to Fa. As a result, the arrival time of sheets to the conveyance sensor 130 exceeds T3 and feeding of sheets becomes impossible in practice. As described, when the roller 101 according to the present embodiment is adopted, the sheet arrival time to the conveyance sensor 130 is changed from vicinity of T0 to vicinity of T2, and then to over T3 where sheet feed becomes practically impossible.

Meanwhile, in the case of a roller where the recessed portions 135 of the knurling all have the same depth, as illustrated by the dashed line of FIG. 11, the knurling remains on the whole circumference after the number of sheet feed exceeds N1, and the pitch of the knurling is not changed. Therefore, the sheet arrival time stays in the vicinity of T0. However, if the number of sheet feed exceeds N2, the knurling starts to disappear across the whole circumference. Therefore, the conveyance force that the roller applies to the sheets drops suddenly across the whole circumference of the roller, and the sheet arrival time to the conveyance sensor 130 is changed from the vicinity of T0 to over T3 where sheet feed becomes practically impossible.

Method for Controlling End-of-Life Signal Detection

Figure 12:
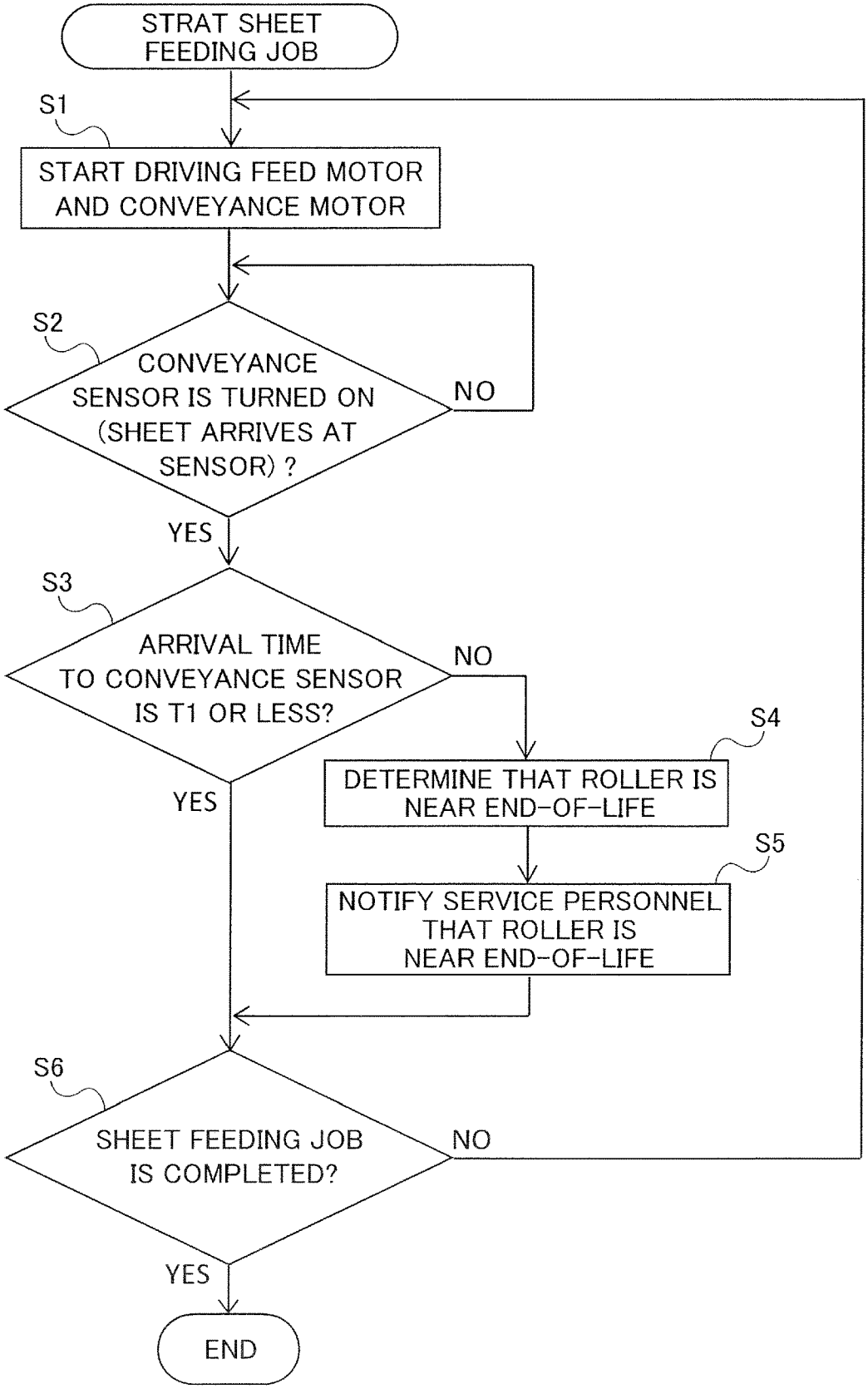
FIG. 12 is a flowchart illustrating a method for controlling a sheet feeding portion according to the first embodiment.

Next, a method for detecting end-of-life signal of the roller will be described with reference to the flowchart of FIG. 12. The respective steps of the flowchart are realized by the controller 260 executing programs stored in the storage device 132. In this example, the roller 101 is adopted as both the pickup roller 110 and the feed roller 111, but a similar control method can be executed if the roller 101 is adopted as for either one of the pickup roller 110 and the feed roller 111.

When the sheet feeding job (i.e., command for feeding sheets from the sheet feeding portion 30) is started to execute, the feed motor M2 and the conveyance motor M3 are started to be driven in step S1. Then, the sheet is fed by the pickup roller 110 and the feed roller 111, and the leading end of the sheet reaches the conveyance sensor 130 in step S2. Then, the controller 260 determines whether the sheet arrival time to the conveyance sensor 130 having been read is equal to or smaller than a length of time (T1) as threshold in step S3. If the sheet arrival time is equal to or smaller than T1, it is determined that end of life of the pickup roller 110 and the feed roller 111 is not near. In that case, the controller 260 determines whether the sheet feeding job is completed in step S6, wherein if the job is not completed, that is, if a subsequent sheet is to be fed, sheet feed operation is started again in step S1, and if the job is completed, the process is ended.

In step S3, if the sheet arrival time exceeds T1, it can be taken that the number of fed sheets has exceeded N1, that is, the knurling of the B-regions on the roller 101 is gone. Therefore, the controller 260 determines that end of life of the roller is near in step S4, and as a notification operation, outputs a notice to a user or a maintenance personnel notifying that the end of life of the roller is near in step S5. One notification method is to send an e-mail to the address of the user or the maintenance personnel stored in the storage device 132 through a local area network connected to the image forming apparatus 1.

After executing the notification process of in step S5, the controller 260 is still capable of continuing the sheet feeding job and also starting a new sheet feeding job. This is because even if the sheet arrival time has exceeded T1 in step S3, knurling remains in the A-regions such that the sheets can be fed (state between N1 and N2 of FIG. 11). Thereafter, as the maintenance personnel having received the notice replaces the roller before the number of sheet feed reaches N2 for example, users can continue using the image forming apparatus without experiencing jamming of sheets or other troubles. If the roller is not replaced even after executing the notification process of step S5 and the sheet arrival time to the conveyance sensor 130 exceeds T3, the sheet feeding job is stopped and an error screen is displayed on the operation display 129 to notify that feeding of sheets is not possible.

As described above, the roller 101 according to the present embodiment includes the protruding portions 136 that constitute the outer circumferential surface 137, the recessed portions 135*a* that are recessed to depth d1 from the outer circumferential surface 137, and the recessed portions 135*b* that are recessed to depth d2 (wherein d2<d1) from the outer circumferential surface 137. In other words, the rotary feeding member according to the present embodiment includes a plurality of first recessed portions (135*a*) that are recessed to a first depth with respect to the outer circumferential surface composed of the plurality of protruding portions, and a plurality of second recessed portions (135*b*) that are recessed to a second depth that is smaller than the first depth with respect to the outer circumferential surface. According to this configuration, during a process in which the surface of the rotary feeding member is gradually worn out, an intermediate state (state between N1 and N2 of FIG. 11) occurs where the function to trap paper dust by the second recessed portions is lost but the function to trap paper dust by the first recessed portions remains.

In this intermediate state, the friction coefficient of the rotary feeding member and the sheet is high enough to convey the sheet at the area near the first recessed portions in the circumferential direction, and low near the second recessed portions so that the roller slips against the sheet by the conveyance resistance of the sheet. That is, in this state, even though the conveyance efficiency is low compared to the initial state where both the first recessed portions and the second recessed portions are functioning, the feeding of the sheet is still feasible. Such intermediate state is maintained until wear of the surface of the rotary feeding member is advanced further and the function of the first recessed portion is lost, that is, until N2 of FIG. 11 is exceeded.

Thus, it becomes possible to detect that the end of life of the rotary feeding member is near, before the feeding of sheets by the rotary feeding member starts to fail frequently. This is because the level of wear of the rotary feeding member can be recognized by whether the first recessed portion remains, while feeding of the sheet itself can be performed by the second recessed portions that remain at the time point where the intermediate state is recognized by the controller, and there is enough time before feeding of the sheets eventually becomes impossible. Meanwhile, in a reference example where the depths of the recessed portions formed on the surface of the roller 101 are uniform (dashed line of FIG. 11), when once the effect of wear of the roller (i.e., deterioration of conveyance efficiency) is recognized, the feeding of sheets has already become impossible or hardly accomplished.

The present embodiment adopts a configuration where the controller 260 automatically determines based on the sheet arrival time to the conveyance sensor 130 whether the end of life of the roller 101 is near, and if necessary, executes a notification operation (step S5 of FIG. 12) to notify the need to replace the roller 101. Thereby, it becomes possible to recommend the user or the maintenance personnel to replace the roller 101 before the jamming of sheets start to occur highly frequently, that is, while the roller 101 is in the intermediate state described above.

Configuration Example

An actual configuration in accordance with the present embodiment will be illustrated. An EPDM rubber (Ethylene Propylene Diene Rubber) having a hardness of 25 to 35 in JIS A hardness, which is a hardness measured by a Type-A durometer in accordance with Japan Industrial Standards JIS K 6253 corresponding to the International Standards ISO 7619, formed into a cylindrical shape with a thickness of 3 mm may be used as the outer portion 133 of the roller 101. The pitch of the knurling of the roller 101 in the circumferential direction should preferably be set to be between 0.7 mm and 1.0 mm.

The depths d1 and d2 of the recessed portions 135*a* and 135*b* with respect to the outer circumferential surface 137 are preferably set to d1=0.5 [mm] and d2=0.3 [mm], in a condition where the roller 101 is not in contact with the sheet. The depths d1 and d2 [mm] of the recessed portions 135*a* and 135*b* are rounded to the first decimal place. This is because it is difficult to form the depths [mm] of protrusions and recesses of the roller 101 to be uniform to the order of the second decimal place. The ratio of d2 and d1 is set within a range of 0 and 1 (0<d2/d1<1). As d2/d1 approximates 1, the margin of time from disappearance of the recessed portions 135*b* to disappearance of the recessed portions 135*a* becomes smaller. Meanwhile, as d2/d1 approximates 0, the recessed portions 135*b* will be eliminated quickly, and the period of time in which the roller 101 is used with the conveyance efficiency deteriorated becomes longer. Therefore, it is preferable to set the range of d2/d1 to be 0.4 or greater and 0.8 or less, more preferably, 0.5 or greater and 0.7 or less. If there are three or more different depths of recessed portions, the maximum depth is set to d1 and the minimum depth is set to d2.

In the cross-section of the roller 101 perpendicular to the direction of the rotation axis of the roller, the ratio of the sum of lengths of the A-regions in the circumferential direction to that of the B-regions should preferably be 2 or more and 3 or less. If the sum of the lengths of the B-regions is too large compared to that of the A-regions, such as if the sum of lengths of the A-regions is somewhat smaller than that of the B-regions, conveyance of the sheet may become impossible at the point of time when knurling in the B-regions is lost. Further, if the sum of lengths of the B-regions is too small compared to the sum of lengths of the A-regions, the deterioration of conveyance efficiency will be extremely small even if the knurling of the B-regions is eliminated. In that case, it may be difficult to determine the level of wear of the roller 101 based on the sheet arrival time to the conveyance sensor 130.

The size of the roller 101 is set so that an axial length is 22 mm and an outer diameter is 18 mm. If the roller 101 is to be used as the pickup roller 110, urging force of the pickup spring 114 (refer to FIG. 3) should preferably be set so that a total load of contact pressure with respect to a sheet is approximately 200 gram-forces. Further, if the roller 101 is used as the feed roller 111, urging force of the retard spring 118 should preferably be set so that a total load of nip pressure at the separation nip 128 is approximately 400 gram-forces.

Modified Examples

Methods other than detecting the deterioration of conveyance efficiency based on the sheet arrival time to the conveyance sensor 130 may be used as the method for detecting end-of-life signal. For example, a configuration can be adopted where an optical sensor for detecting whether a surface of the roller 101 has protrusions and recesses having a predetermined depth or greater is provided, and end of life is determined to be near if it is determined that the B-regions has become smooth, that is, the depth of the protrusions and recesses have become smaller than a threshold value. Further, instead of adopting a configuration where the controller 260 automatically executes end-of-life signal detection, it may be possible to adopt a configuration where a user or a maintenance personnel determines through visual confirmation whether knurling in the B-regions of the roller 101 still exists (refer to FIG. 9A). In this case, a mark may be embedded in the B-regions that is not visible when there are protrusions and recesses on the roller surface, and that becomes visible if the roller surface becomes flat.

Although according to the present embodiment, notification via email to the maintenance personnel is performed as the action step S5) when it is determined that end of life of the roller 101 is near based on the sheet arrival time to the conveyance sensor 130, another countermeasure may also be performed. For example, if it is determined that end of life of the roller 101 is near, it may be possible to display information recommending replacement of the roller 101 on the operation display 129, or to display information recommending a user to contact a maintenance personnel. It may also be possible to reduce the frequency of use of the sheet feeding portion 30 including the roller 101 whose end of life has been determined to be near, and to use a different sheet feeding portion 30 storing the same sized sheets to thereby improve the durability of the whole image forming apparatus.

The present embodiment has described that the recessed portions 135 that are formed as groove shaped portions that extend in the rotation axis direction, i.e., sheet width direction, of the roller 101 serve as an example of the protrusions and recesses where parallel grooves are formed on the roller surface. However, as long as the protrusions and recesses extend in a direction intersecting the circumferential direction of the roller 101, the grooves may be slanted with respect to the rotation axis direction. For example, it may be possible to adopt a configuration where a plurality of helical protrusions and recesses are arranged, similarly to a helical gear, or it may be possible to combine helical protrusions and recesses where the winding directions differ, similarly to a so-called double helical gear. In any of these cases, an effect similar to the present embodiment can be achieved if a plurality of protruding portions and a plurality of first and second recessed portions that have different depths are formed on the roller surface on the cross-section taken from the sheet width direction.

As described earlier, the roller 101 according to the present embodiment can be used for either one of or both the pickup roller 110 and the feed roller 111 of the sheet feeding portion 30. If the roller 101 is adopted to only one of the pickup roller 110 and the feed roller 111, the other one of the rollers may adopt a roller having a smooth surface, or a roller having protrusions and recesses with a constant depth across the whole circumference formed on the surface thereof.

Second Embodiment

Now, a second embodiment will be described with reference to the drawings of FIG. 13. According to the present embodiment, a surface shape of a roller 201 used as a rotary feeding member differs from the first embodiment. The other common elements as the first embodiment are denoted with the same reference numbers as the first embodiment and descriptions thereof are omitted.

Figure 13A:
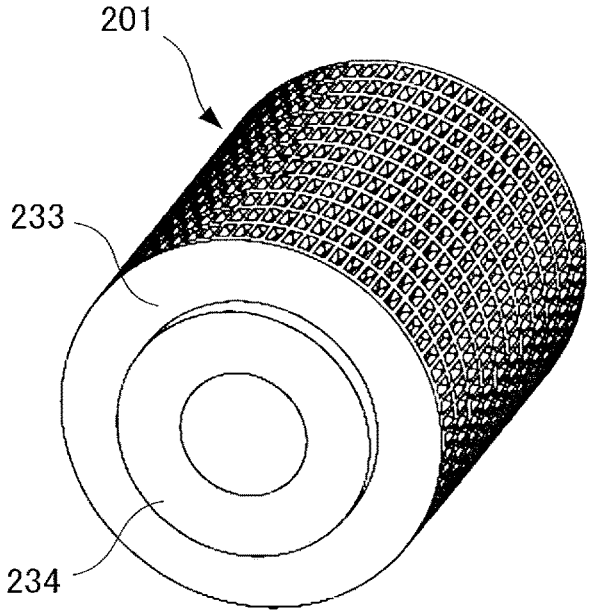
FIG. 13A is a perspective view of a roller according to a second embodiment.

FIG. 13A is a perspective view of the roller 201 according to the present embodiment. The roller 201 includes a core 234 and an outer portion 233, and similar to the roller 101 of the first embodiment, it can be adopted to either one of or both the pickup roller 110 and the feed roller 111 of the sheet feeding portion 30.

Figure 13B:
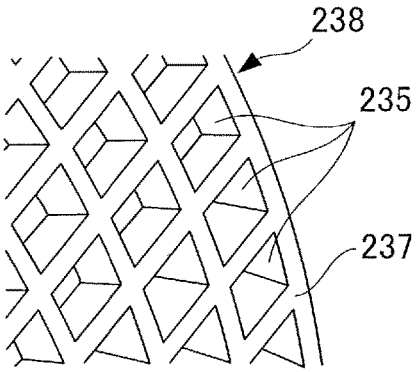
FIG. 13B is an enlarged view of the roller according to the second embodiment.

As illustrated in FIG. 13B, a crest portion 238 that is a lattice-shaped projected structure and a plurality of recessed portions 235 in the form of rectangular cells defined by the crest portion 238 are provided on the surface of the outer portion 233. As illustrated in the cross-sectional view of FIG. 13C and the enlarged cross-sectional view of FIG. 13D, in the cross-section viewed from the width direction, that is, rotation axis direction of the roller 201, the crest portion 238 appears as a plurality of protruding portions 236, while the recessed portions 235 are recesses that are formed between any adjacent two of the protruding portions 236. It is noted that in the cross-sectional position that does not pass the recessed portions 235, the crest portion 238 appears as a circumferential surface formed across the whole circumference. Since the recessed portions 235 trap paper dust brought by conveying sheets, similar to the recessed portions 135 in the first embodiment, they exert an effect of reducing the deterioration of conveyance efficiency by adhesion of paper dust on the crest portion 238.

Figure 13C:
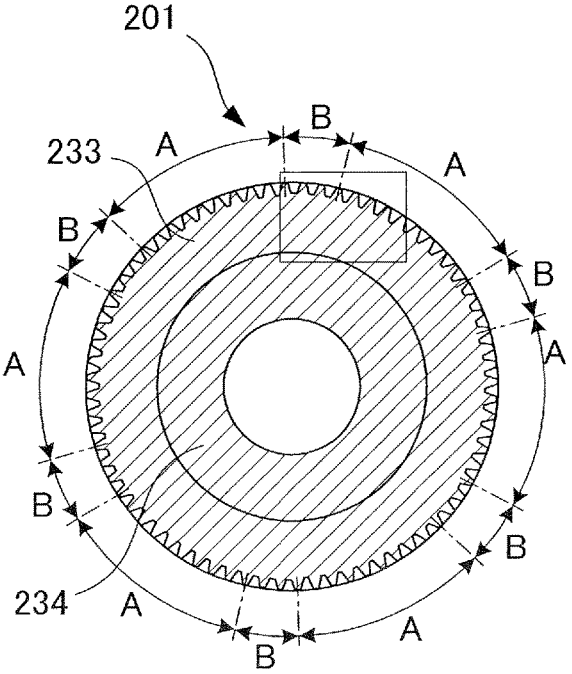
FIG. 13C is a cross-sectional view of the roller according to the second embodiment.
Figure 13D:
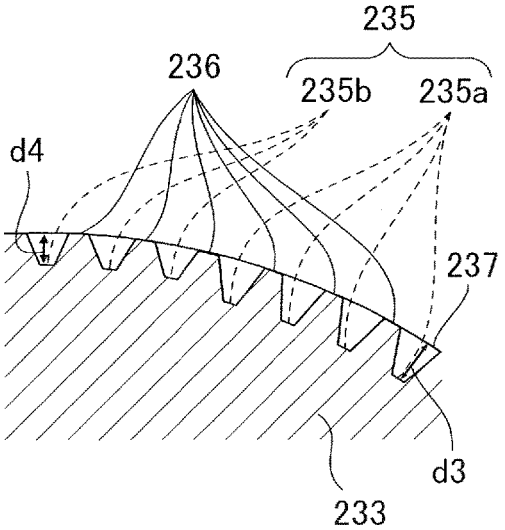
FIG. 13D is an enlarged view of the roller according to the second embodiment.

As illustrated in FIGS. 13C and 13D, the roller 201 is provided with A-regions where relatively deep recessed portions 235*a* (first recessed portions in the present embodiment) are formed, and B-regions where relatively shallow recessed portions 235*b* (second recessed portions in the present embodiment) are formed. A depth d4 of the recessed portions 235*b* in the B-regions is smaller than a depth d3 of the recessed portions 235*a* in the A-regions (d4<d3). The A-regions and the B-regions are alternately arranged with respect to the circumferential direction. Further, a plurality of recessed portions 235*a* are provided in each A-region, and a plurality of recessed portions 235*b* are provided in each B-region. The actual configurations such as the rubber material constituting the outer portion 233, the pitch of the protrusions and recesses, and the ratio of depths of the recessed portions 235*a* and 235*b* (d4/d3) may be set to the same values as the first embodiment.

If sheets are repeatedly fed using the roller 201, the sheet arrival time to the conveyance sensor 130 is changed in a stepped manner from vicinity of T0 to vicinity of T2, and then to over T3 where sheet feed becomes impossible in practice, similar to the first embodiment (refer to FIG. 11). That is, after feeding a certain number (N1) of sheets, the crest portion 238 is worn out and an intermediate state occurs where the protrusions and recesses in the B-regions are eliminated while the protrusions and recesses in the A-regions remain. In this state, the conveyance efficiency of the roller 201 is deteriorated by the deterioration of conveyance force of the B-regions, but the feeding of sheets can be performed by the A-regions. Accordingly, though the sheet arrival time (T2) to the conveyance sensor 130 is delayed compared to the initial time (T0), it is still earlier than T3. Thereafter, if feeding of sheets is repeated further, the protrusions and recesses in the A-regions are also eliminated and the feeding of sheets becomes impossible.

As described, even by adopting a shape of the roller 201 according to the present embodiment, it becomes possible to detect nearing of end of life of the roller 201 before the feeding of sheets start to fail frequently.

Especially according to the present invention, the plurality of protruding portions 236 appearing on the cross-section perpendicular to the width direction are unified as the lattice shaped crest portion 238 when viewed from the outside of the roller (refer to FIGS. 13B and 13D). That is, the crest portion 238 constitutes an outer circumferential surface 237 of the roller 201 expanding laterally and longitudinally, instead of a plurality of protrusions that are formed separately from each other when viewed from the outside of the roller 201. Here, in order to reduce the effect of paper dust, it is effective to narrow the pitch of the protrusions and recesses in the circumferential direction, as described above (refer to FIG. 8). However, as the pitch narrows, stress is concentrated to protruding portions that are in contact with the sheet, the amount of deformation of the protruding portions is increased, and only the edge portions of the protruding portions in the circumferential direction may come in contact with the sheet in line contact, such that the roller 201 may not be able to exert the desired conveyance force. Meanwhile, according to the configuration of the present embodiment, since the crest portion 238 is formed in a lattice shape, the outer circumferential surface 237 formed by the crest portion 238 comes into surface contact with the sheet, regardless of the pitch of the lattice. Therefore, it becomes possible to realize both the effect of reducing the adhesion of paper dust by narrowing the pitch of the lattice of the crest portion 238 and the effect of realizing stable conveyance of sheets in a highly effective manner.

The lattice pattern configured by the crest portion 238 is not restricted to rectangles, and the lattice can adopt a triangular lattice shape or a pattern where circular recessed portions, i.e., dimples, are arranged periodically when viewed from the outside in radial directions.

Third Embodiment

Next, a third embodiment will be described with reference to the drawings of FIG. 14. According to the present embodiment, a surface shape of a roller 301 used as a rotary feeding member differs from the above-described embodiment. The other common elements as the first embodiment are denoted with the same reference numbers as the first embodiment and descriptions thereof are omitted.

Figure 14A:
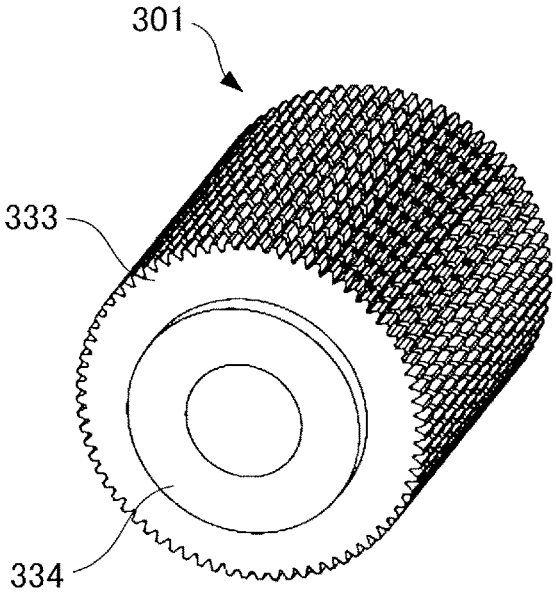
FIG. 14A is a perspective view of a roller according to a third embodiment.

FIG. 14A is a perspective view of the roller 301 according to the present embodiment. The roller 301 includes a core 334 and an outer portion 333, and similar to the roller 101 of the first embodiment, it can be adopted as either one of or both the pickup roller 110 and the feed roller 111 of the sheet feeding portion 30.

Figure 14B:
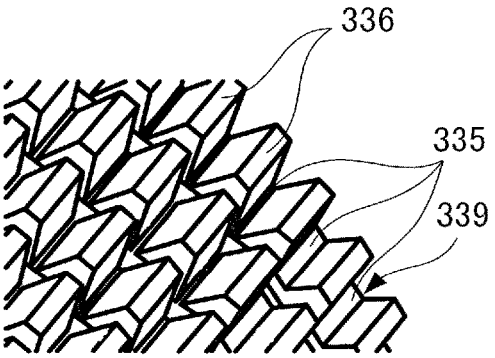
FIG. 14B is an enlarged view of the roller according to the third embodiment.

As illustrated in FIG. 14B, a plurality of protruding portions 336 that are arranged regularly in the rotation axis direction, i.e., sheet width direction, and in the circumferential direction of the roller 301, and a bottom portion 339 of the lattice shape that defines the protruding portions 336 are formed on the surface of the outer portion 333. As illustrated in the cross-sectional view of FIG. 14C and the enlarged cross-sectional view of FIG. 14D, the bottom portion 339 appears as recessed portions 335 that are formed between any adjacent two of the protruding portions 336 on the cross-section perpendicular to the width direction, that is, rotation axis direction of the roller 301. In other words, the recessed portions 335*a* and 335*b* are unified as a lattice shaped surface that defines the protruding portions 336 when viewed from the outside of the roller 301. Tip faces at the outer ends of the protruding portions 336 in radial directions constitute a cylindrical outer circumferential surface 337 of the roller 301 that comes in contact with the sheet. In the cross-sectional position that does not pass through the protruding portions 336, the bottom portion 339 is located at the outer periphery of the roller 301. The recessed portions 335 trap paper dust that is brought by conveying sheets, similar to the recessed portions 135 in the first embodiment and exert an effect of reducing the deterioration of conveyance efficiency by the attachment of paper dust on the protruding portions 336.

Figure 14C:
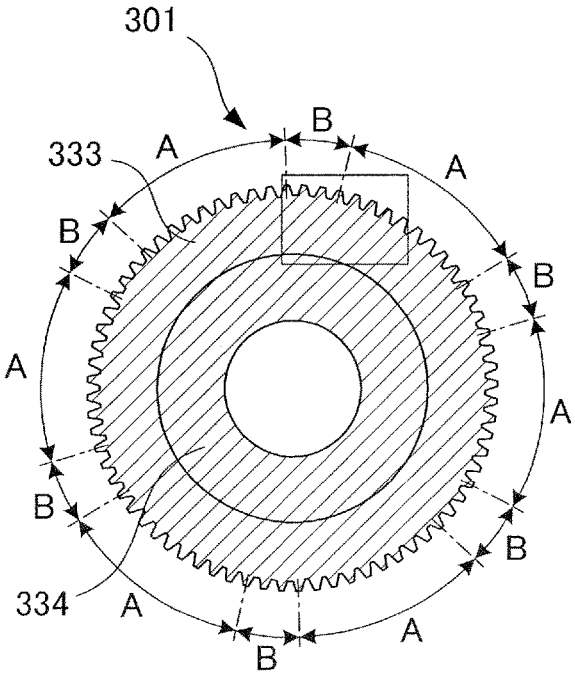
FIG. 14C is a cross-sectional view of the roller according to the third embodiment.
Figure 14D:
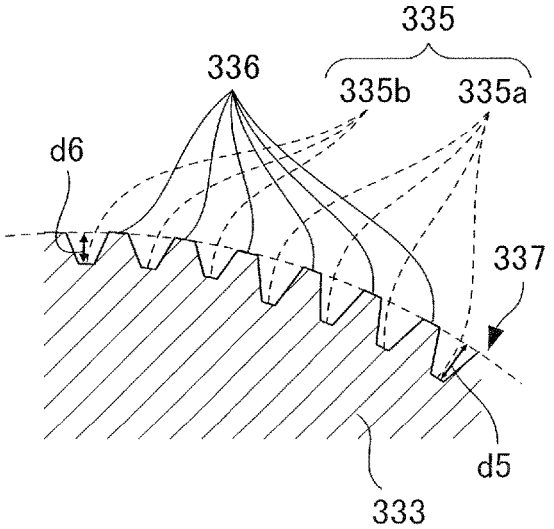
FIG. 14D is an enlarged view of the roller according to the third embodiment.

Now, as illustrated in FIGS. 14C and 14D, the roller 301 is provided with A-regions where relatively deep recessed portions 335*a* (first recessed portions in the present embodiment), and B-regions where relatively shallow recessed portions 335*b* (second recessed portions in the present embodiment) are formed. The A-regions and the B-regions are alternately arranged in terms of the circumferential direction. A depth d6 of the recessed portions 335*b* in the B-regions is smaller than a depth d5 of the recessed portions 335*a* in the A-regions (d6<d5). Further, a plurality of recessed portions 335*a* are provided in each A-region, and a plurality of recessed portions 335*b* are provided in each B-region. The actual configurations such as the rubber material constituting the outer portion 333, the pitch of the protrusions and recesses, and the ratio of depths of the recessed portions 335*a* and 335*b* (d5/d6) may be set to the same values as the first and second embodiments.

If feeding of sheets are repeatedly fed using the roller 301, the sheet arrival time to the conveyance sensor 130 is changed in a stepped manner from vicinity of T0 to vicinity of T2, and then to over T3 where sheet feed becomes impossible in practice, similar to the first embodiment (refer to FIG. 11). That is, after feeding a certain number (N1) of sheets, the protruding portions 336 are worn out and an intermediate state occurs where the protrusions and recesses in the B-regions are eliminated while the protrusions and recesses in the A-regions remain. In this state, the conveyance efficiency of the roller 301 is deteriorated as deterioration in conveyance force exerted by the B-regions, but the feeding of sheets is still feasible with the A-regions. Accordingly, though the sheet arrival time (T2) to the conveyance sensor 130 is delayed compared to the initial time (T0), it is still earlier than T3. Thereafter, if feeding of sheets is repeated further, the protrusions and recesses of the A-regions are also eliminated, and the feeding of sheets becomes practically impossible.

As described, even by adopting a shape of the roller 301 according to the present embodiment, it becomes possible to detect nearing of end of life of the roller 301 before the feeding of sheets start to fail frequently.

Other Embodiments

The examples of the surface shape of the rotary feeding member have been illustrated in the first to third embodiments, but an effect similar to the embodiments may be achieved as long as the surface shape includes relatively deep first recessed portions and relatively shallow second recessed portions at least at a portion of the cross-sections of the roller viewed from the width direction of the sheet.

In such modifications, a configuration is preferred where first regions in which the first recessed portions are arranged and second regions in which the second recessed portions are arranged to both have a certain width in the circumferential direction, and in each region, a plurality of first recessed portions or a plurality of second recessed portions are arranged collectively. The reason for this is that if the first recessed portions and the second recessed portions are alternately arranged one by one in the circumferential direction, when the second recessed portions are worn out and eliminated, the pitch of the remaining protrusions and recesses (interval between one first recessed portion and the adjacent recessed portion) will be widened. In such case, even if the first recessed portions remain, the interval between remaining recessed portions (i.e., the first recessed portions) becomes too wide, such that the influence of paper dust cannot be reduced, and the conveyance force applied on the sheet is deteriorated (refer to FIG. 8). Such deterioration of conveyance force occurs across the whole circumferential direction, and conveyance force that differs in the circumferential direction, as illustrated in FIG. 10, may not be realized. As a result, if the conveyance force exceeds the force necessary to convey the sheet (Fn), it is difficult to detect the deterioration of conveyance efficiency using the conveyance sensor 130, and if the conveyance force falls below Fn, it may become impossible in practice to feed the sheets.

Meanwhile, if a plurality of first recessed portions or second recessed portions are arranged collectively in each region, even if the second recessed portions are eliminated, the interval of the first recessed portions will not be changed from the initial state, at least in the first regions. Thus, in an intermediate state where the second recessed portions are eliminated and the first recessed portions remain, it becomes possible to ensure the necessary conveyance force to feed sheets.

Even if recessed portions having different depths are provided, a random or nearly random distribution of depths of the recessed portions, such as in a roller having a roughened surface, the effects of the first to third embodiments will not be achieved. If the depths of the recessed portions are random, after repeated feeding of sheets, the recesses having shallower depths will be eliminated across the whole circumferential direction, and conveyance force that differs in the circumferential direction, as illustrated in FIG. 10, will not be realized. Therefore, it is preferred to adopt a surface shape where a plurality of first recessed portions having a relatively deep depth and a plurality of second recessed portions having a relatively shallow depth are provided on the cross-section viewed from the width direction of the sheet.

According to the first to third embodiments described above, there are two different depths of recessed portions, but it is also possible to provide recessed portions having a third depth that differs from the first and second depths as a configuration where three or more depths are provided.

The rollers 101, 201 and 301 illustrated in the first, second and third embodiments are examples of the rotary feeding member, and it is also possible to provide the surface shapes illustrated in the respective embodiments to the surface of a belt member that is stretched across roller members and that is rotated to feed sheets. Further, the rollers 101, 201 and 301 may be used in a feeding configuration that differs from the above-described sheet feed unit 100 including both the pickup roller 110 and the feed roller 111. For example, a configuration can be adopted where one roller member is arranged to contact both the sheet supported on the sheet supporting portion and the separation member opposed to the roller member, thereby realizing a configuration where the roller member have both the function to send out the sheet from the sheet supporting portion and to separate the sheet while conveying the same.

The sheet feeding portion 30 described above is one example of the sheet feeding apparatus, and for example, the present technique can be applied to a sheet feeding apparatus configured to feed sheets which are documents in the image reading apparatus 202.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-010027, filed on Jan. 24, 2018, which is hereby incorporated by reference herein in its entirety.

What is claimed is:

1. A rotary feeding member configured to feed a sheet by rotating in contact with the sheet, the rotary feeding member comprising:

a plurality of first regions each including a plurality of first protruding portions and a plurality of first recessed portions, the plurality of first protruding portions being provided, on a cross-section perpendicular to a rotation axis direction of the rotary feeding member, at a plurality of positions in a rotating direction of the rotary feeding member; and a plurality of second regions each including a plurality of second protruding portions and a plurality of second recessed portions, the plurality of second protruding portions being provided, on the cross-section, at a plurality of positions in the rotating direction of the rotary feeding member, wherein the plurality of first protruding portions and the plurality of second protruding portions constitute an outer circumferential surface of the rotary feeding member to be in contact with the sheet, wherein the plurality of first recessed portions are each provided, on the cross-section, between any adjacent two of the plurality of first protruding portions in the rotating direction, the plurality of first recessed portions being recessed to a first depth with respect to the outer circumferential surface, wherein the plurality of second recessed portions are each provided, on the cross-section, between any adjacent two of the plurality of second protruding portions in the rotating direction, the plurality of second recessed portions being recessed to a second depth smaller than the first depth with respect to the outer circumferential surface, wherein on the cross-section, the plurality of first regions and the plurality of second regions are alternately arranged in the rotating direction, and wherein a ratio of the second depth to the first depth is 0.4 or greater and 0.8 or less.

2. The rotary feeding member according to claim 1, wherein on the cross-section perpendicular to the rotation axis direction, a ratio of a sum of lengths in the rotating direction of the plurality of first regions to that of the plurality of second regions is 2 or greater and 3 or less.

3. The rotary feeding member according to claim 1, wherein both the plurality of first recessed portions and the plurality of second recessed portions are grooves extending in a direction intersecting the rotating direction.

4. The rotary feeding member according to claim 3, wherein the grooves extend in parallel with the rotation axis direction from one end to the other end of the rotary feeding member in the rotation axis direction.

5. The rotary feeding member according to claim 1, wherein the outer circumferential surface is a lattice shape when viewed from an outside of the rotary feeding member, the plurality of first protruding portions and the plurality of second protruding portions being portions of the lattice shape on the cross-section, and wherein when viewed from the outside, the plurality of first recessed portions and the plurality of second recessed portions are recessed shapes that are separated from each other by the lattice shape of the outer circumferential surface.

6. The rotary feeding member according to claim 1, wherein the plurality of first protruding portions and the plurality of second protruding portions are protrusions separated from each other when viewed from an outside of the rotary feeding member, wherein when viewed from the outside, the plurality of first recessed portions at the first depth and the plurality of second recessed portions at the second depth are arranged to form a lattice shaped surface that separates the protrusions from each other.

7. The rotary feeding member according to claim 1, wherein a ratio of the second depth to the first depth is 0.5 or greater and 0.7 or less.

8. The rotary feeding member according to claim 1, wherein the rotary feeding member comprises a core formed of synthetic resin and an outer portion attached on an outer circumference of the core, and wherein the plurality of first protruding portions, the plurality of second protruding portions, the plurality of first recessed portions and the plurality of second recessed portions are formed on the outer portion.

9. The rotary feeding member according to claim 1, wherein a number of the first protruding portions within each of the plurality of first regions is greater than a number of the second protruding portions within each of the plurality of second regions.

10. A sheet feeding apparatus comprising:

a sheet supporting portion configured to support a sheet;

a rotary feeding member configured to feed the sheet in a sheet feeding direction by rotating in contact with the sheet supported on the sheet supporting portion;

a sheet detector configured to detect the sheet at a position downstream of the rotary feeding member in the sheet feeding direction; and a controller configured to execute a notification operation of notifying of information about replacement of the rotary feeding member based on a detection result of the sheet detector, wherein the rotary feeding member comprises:

a plurality of first regions each including a plurality of first protruding portions and a plurality of first recessed portions, the plurality of first protruding portions being provided, on a cross-section perpendicular to a rotation axis direction of the rotary feeding member, at a plurality of positions in a rotating direction of the rotary feeding member; and a plurality of second regions each including a plurality of second protruding portions and a plurality of second recessed portions, the plurality of second protruding portions being provided, on the cross-section, at a plurality of positions in the rotating direction of the rotary feeding member, wherein the plurality of first protruding portions and the plurality of second protruding portions constitute an outer circumferential surface of the rotary feeding member to be in contact with the sheet, wherein the plurality of first recessed portions are each provided, on the cross-section, between any adjacent two of the plurality of first protruding portions in the rotating direction, the plurality of first recessed portions being recessed to a first depth with respect to the outer circumferential surface, wherein the plurality of second recessed portions are each provided, on the cross-section, between any adjacent two of the plurality of second protruding portions in the rotating direction, the plurality of second recessed portions being recessed to a second depth smaller than the first depth with respect to the outer circumferential surface, wherein on the cross-section, the plurality of first regions and the plurality of second regions are alternately arranged in the rotating direction, and wherein a ratio of the second depth to the first depth is 0.4 or greater and 0.8 or less.

11. The sheet feeding apparatus according to claim 10, wherein the controller executes the notification operation if an elapsed time, from start of rotation of the rotary feeding member to detection of the sheet by the sheet detector, exceeds a predetermined length of time.

12. The sheet feeding apparatus according to claim 10, further comprising a communication unit through which the controller communicates with an external device, and wherein in the notification operation, the controller transmits a signal through the communication unit to the external device that causes the external device to display information recommending replacement of the rotary feeding member.

13. The sheet feeding apparatus according to claim 10, further comprising a display device configured to display information, wherein in the notification operation, the controller controls the display device to display information recommending replacement of the rotary feeding member.

14. The sheet feeding apparatus according to claim 10, wherein the rotary feeding member comprises a first roller arranged above the sheet supporting portion and configured to rotate in contact with an upper surface of the sheet supported on the sheet supporting portion so as to deliver the sheet out of the sheet supporting portion.

15. The sheet feeding apparatus according to claim 10, further comprising a separation member configured to separate sheets, wherein the rotary feeding member comprises a second roller configured to feed the sheet in contact with the separation member such that the sheet is separated from another sheet at a nip portion between the rotary feeding member and the separation member.

16. The sheet feeding apparatus according to claim 10, wherein the rotary feeding member is a roller member, in which the outer circumferential surface is a cylindrical shape centering on a rotation axis of the roller member, and in which the plurality of first recessed portions and the plurality of second recessed portions are recessed from the outer circumferential surface inwardly toward the rotation axis.

17. The sheet feeding apparatus according to claim 10, wherein a number of the first protruding portions within each of the plurality of first regions is greater than a number of the second protruding portions within each of the plurality of second regions.

18. An image forming apparatus comprising:

a rotary feeding member configured to feed a sheet by rotating in contact with the sheet; and an image forming unit configured to form an image on a sheet fed by the rotary feeding member;

wherein the rotary feeding member comprises:

a plurality of first regions each including a plurality of first protruding portions and a plurality of first recessed portions, the plurality of first protruding portions being provided, on a cross-section perpendicular to a rotation axis direction of the rotary feeding member, at a plurality of positions in a rotating direction of the rotary feeding member; and a plurality of second regions each including a plurality of second protruding portions and a plurality of second recessed portions, the plurality of second protruding portions being provided, on the cross-section, at a plurality of positions in the rotating direction of the rotary feeding member, wherein the plurality of first protruding portions and the plurality of second protruding portions constitute an outer circumferential surface of the rotary feeding member to be in contact with the sheet, wherein the plurality of first recessed portions are each provided, on the cross-section, between any adjacent two of the plurality of first protruding portions in the rotating direction, the plurality of first recessed portions being recessed to a first depth with respect to the outer circumferential surface, wherein the plurality of second recessed portions are each provided, on the cross-section, between any adjacent two of the plurality of second protruding portions in the rotating direction, the plurality of second recessed portions being recessed to a second depth smaller than the first depth with respect to the outer circumferential surface, wherein on the cross-section, the plurality of first regions and the plurality of second regions are alternately arranged in the rotating direction, and wherein a ratio of the second depth to the first depth is 0.4 or greater and 0.8 or less.

* * * * *